United States Patent [19]

Levasseur

[11] Patent Number: 4,526,263

[45] Date of Patent: Jul. 2, 1985

[54] LOCK-AHEAD VEND CONTROL EMPLOYING A COMMON VEND ENERGIZATION MONITOR TO EFFECT VEND SELECTION RECOGNITION FOR VENDING

[75] Inventor: Joseph L. Levasseur, Chesterfield, Mo.

[73] Assignee: H. R. Electronics Company, St. Louis, Mo.

[21] Appl. No.: 504,887

[22] Filed: Jun. 16, 1983

[51] Int. Cl.[3] ..... G07F 5/16

[52] U.S. Cl. ..... 194/1 N; 221/5

[58] Field of Search ..... 194/1 N, DIG. 2, DIG. 14; 364/479; 340/825.33, 825.35; 221/125, 5

[56] References Cited

U.S. PATENT DOCUMENTS 4,376,478 3/1983 Sugimoto et al. ..... 194/1 N

*Primary Examiner*—Stanley H. Tollberg

*Attorney, Agent, or Firm*—Haverstock, Garrett & Roberts

[57] ABSTRACT

A vend control circuit for a multi-channel vendor, including a credit entry circuit, a plurality of selection switches actuatable for selecting different vend selections, a plurality of vend motors, each vend selection having a vend motor associated therewith, a plurality of vend channels each of which may have a different, pre-established vend price associated therewith, a master control circuit for accumulating total credit entered, which master control circuit sequentially compares the total credit entered against the vend prices of each of the vend channels and produces for each such comparison a vend channel authorization signal if the total credit deposited at least equals the vend price, a delivery control circuit for effecting energization of a particular vend motor when a vend selection switch with which such particular vend motor is associated is actuated during the time that a vend channel authorization signal is being produced for the vend channel to which the actuated switch belongs, and a monitor circuit connected in common to the plurality of vend channels for detecting the energization of any vend motor, the master control circuit responsive to detection of such vend motor energization to terminate further sequential comparison and to effect vend delivery circuit lock-up for a sufficiently long enough period to permit the energized vend motor to operate.

60 Claims, 12 Drawing Figures

LOCK-AHEAD VEND CONTROL EMPLOYING A COMMON VEND ENERGIZATION MONITOR TO EFFECT VEND SELECTION RECOGNITION FOR VENDING

BACKGROUND OF THE INVENTION

The present invention relates to a Look-Ahead Vend Control Employing A Common Vend Energization Monitor To Effect Vend Selection Recognition For Vending, and especially to a vend control which employs a monitor common to a plurality of channels of a multi-channel vendor for detecting the energization of a vend delivery means appropriate for the vend selection made by a customer and for communicating to the master control means of the vend control that an appropriate vend delivery circuit has been completed, and in which the master control means of the vend control is responsive to such communication to effect vend delivery circuit lockup for a sufficiently long enough period to permit the appropriate vend delivery means to effect vend delivery.

For many years now single channel vending systems, including vendors and vend controls therefor, have been known which have been capable of vending a selected item from among a number of possible vend selections, all of which have had the same vend price. With such vendors it has become a common practice to utilize a vend control which compares the total credit entered against the common vend price, generates a single vend signal, if appropriate, regardless of the vend selected, and routes such vend signal by appropriate means, such as through a daisy-chained selection switch circuit, to the desired vend delivery means to effect energization thereof.

Over the years other vendors and vend controls therefor, which may be generally described as multi-channel vending systems, have also become known, and with such systems it is now possible to vend from among a plurality of items, some of which are differently priced from one another. A number of commercial vend controls are presently on the market and can be employed with appropriate multi-channel vendors for vending from such vendors different products having, variously, four, or ten, and occasionally even more, different prices.

In going from single to multi-channel vending systems, and in increasing the number of channels available as well as the number of selections per channel available in the multi-channel systems, it was found that an ever increasing amount of circuitry of increasing complexity seemed to be required, with much of the circuitry being replicated for each vend selection. Such replication was recognized as an undesirable trait which militated against both miniaturization of vend controls and minimization of interface connections between the vendors and the vend controls therefor. As a result, attempts were undertaken to develop new control systems which would reduce the amount of replication required and would simplify and minimize the number of interface connections required between vendors and vend controls. Particularly advantageous advances in this regard were realized with the developments of control circuits that employ, for each channel of a vendor, a separate selection monitor means that is common to the selections belonging to such vend channel and which detects the actuation of any of the various selection means associated with such channel and in response thereto communicates to a master control means information indicating that a vend selection belonging to such channel has been made, which information is utilized by the master control means in determining whether or not a vend should be authorized over such channel. Typical of such control circuits and the selection monitor means employed therein are those described in U.S. Pat. Nos. 3,828,903 and 4,234,070. While such selection monitor means have proven extremely advantageous for single channel vendors, their use with multi-channel vendors still requires, in many instances, more circuitry, and replication of circuitry, than is desirable. As is shown in U.S. Pat. No. 3,828,903, which is assigned to Applicant's assignee, and as is also apparent in U.S. Pat. No. 4,234,070, multi-channel vendors have, for the most part and until the present, still required the use of a separate selection monitor for each channel of such vendor, with the attendant replication of circuitry and consequent disadvantages thereof.

SUMMARY OF THE INVENTION

The present invention eliminates the need for separate selection monitors for each channel of a multi-channel vending system, and such invention therefore makes it possible to significantly reduce the amount and replication of circuitry and the number of interface connectors required in vend controls for multi-channel vendors. The vend control system of the present invention is intended for use with a vendor for vending a plurality of vend selections, at least some of which are distinguishable from one another on the basis of a vend characteristic, such as price. Typically, such a vendor will have a predetermined vend price associated with each vend channel and will include delivery control means, including a plurality of vend delivery means, and customer actuatable selection means for selecting among the plurality of possible vends, with the selection means being operatively connected to the delivery control means to communicate selection information thereto and wherein each vend selection is associated with a particular vend channel and has a vend delivery means associated therewith. The subject vend control circuit includes credit entry means for receiving credit entries and for generating credit information signals, master control means operatively connected to the credit entry means to receive the credit information signals therefrom, to accumulate total credit entered, and to produce vend channel authorization signals, when appropriate, and means for communicating the vend channel authorization signals that are produced by the master control means to the delivery control means. The master control means of the vend control circuit is operable to sequentially compare the total credit entered against the respective predetermined vend prices of the various vend channels without regard for the particular selection made or for the vend channel of which such selection is a part, and to produce for each comparison operation a respective vend channel authorization signal if the total credit entered equals or exceeds the vend price associated with the respective vend channel. The vend control circuit also includes vend energization monitor means for detecting energization of any vend delivery means, which monitor means includes a first portion connected in series circuit with the means for supplying power to the vend delivery means and in common to the plurality of vend delivery means, and a second portion under control of the first portion and responsive to the energization of the first portion to produce a vend energized output signal, and other means for communicating the vend energized output signal to the master control means. Energization of the vend delivery means associated with the desired vend selection is effected by the communication to the vend delivery control means of a vend channel authorization signal authorizing a vend from the vend channel with which the desired vend is associated at the same time as selection information identifying the desired vend selection is being communicated to the vend delivery control means. As a result of an energization of a vend delivery means a vend energized output signal is produced by the vend energization monitor and is provided to the master control means which is responsive thereto to terminate further comparisons by the master control means and to thereby lock in and maintain the vend channel authorization signal then being produced by the vend control means for a sufficiently long enough period to allow the energized vend delivery means to operate.

It is therefore a principal object of the present invention to provide a new and improved vend control circuit for use with a multi-channel vendor.

A further object is to teach the construction and operation of a vend control system which reduces the amount and replication of circuitry required by vend control circuits for use with multi-channel vendors.

Another object is to provide a vend control circuit which eliminates the need for separate selection monitor circuits for each of the different channels of a multi-channel vendor.

A still further object is to teach the construction and operation of a vend control system which employs a common vend energization monitor to effect vend selection recognition for vending.

Another important object of the present invention is to provide a vend control circuit with look-ahead vend circuitry.

A further object of the present invention is to teach the construction and operation of a vend control circuit in which comparisons of credit deposits against vend prices are made independently of the vend selection selected, yet only the proper vend selection is effected when a sufficient deposit for the vend price of such product has been made.

A still further object of the present invention is to teach the construction and operation of a vend control circuit wherein vend channel authorization signals are produced on a look-ahead basis and are locked in by detection by a monitor of a vend energization of the vend delivery means for the particular vend selection selected.

These and other objects and advantages of the present invention will become apparent after considering the following detailed specification in conjunction with the accompanying drawings, wherein:

DESCRIPTION OF THE PREFERRED EMBODIMENTS

Figure 1:
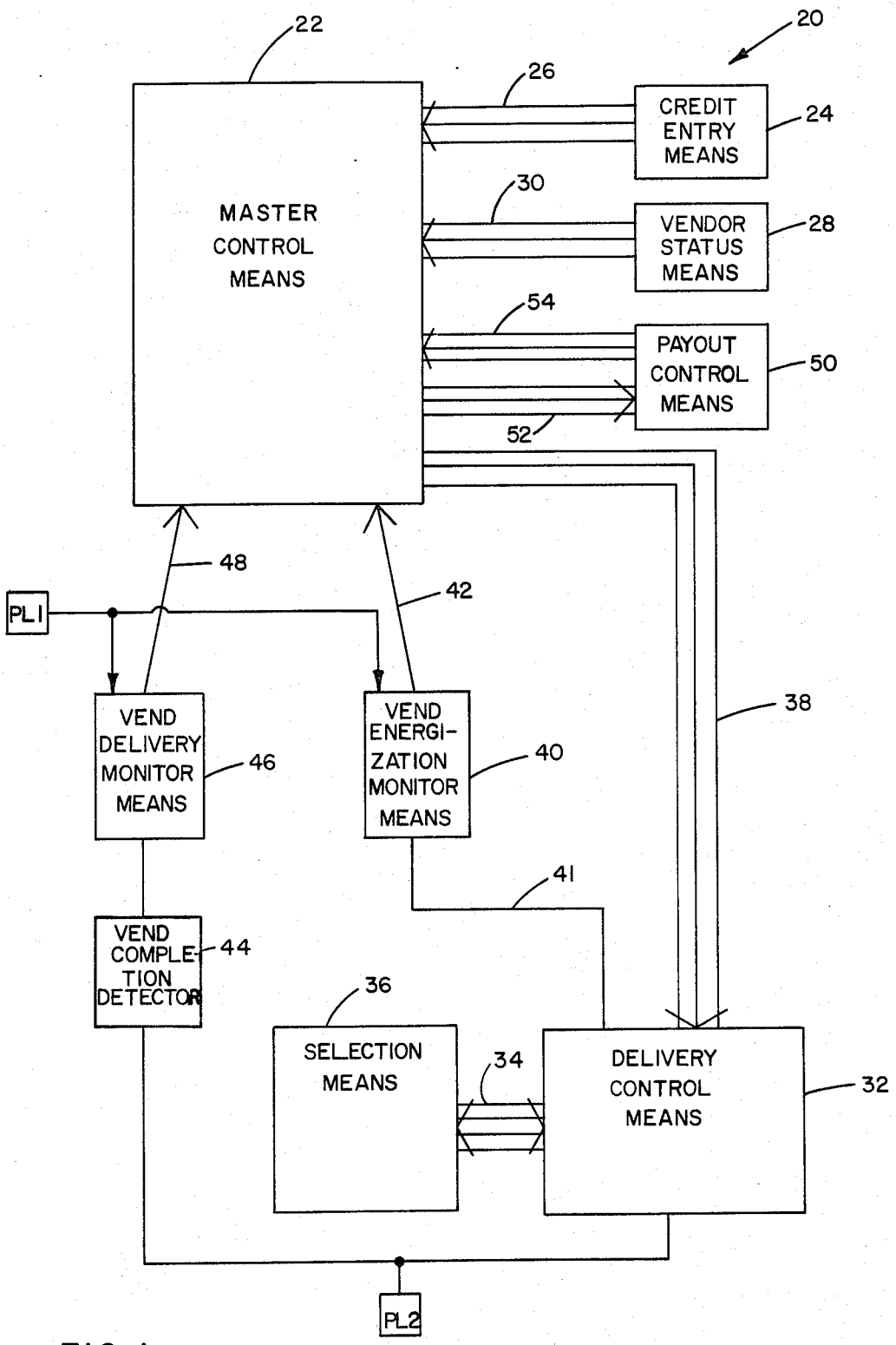
FIG. 1 is a block diagram of one embodiment of the vending control circuit of the present invention.

In the descriptions which follow and in the drawing figures, numerals having a "P" prefix, such as "P7", refer to and identify pin numbers of integrated circuit chips; numerals having a "PL" prefix, such as "PL1", refer to and identify power connectors or power leads; and numbers having a "CP" prefix, such as "CP2*a*" and "CP2*b*" refer to and identify various connection points of connection point pairs in the circuit, which connection point pairs may or may not be jumpered together, depending upon particular operational characteristics desired. Some connection points may belong to several connection point pairs and may therefore include dual connection point designations, i.e., a particular connection might be identified as both "CP1*b*" and "CP4*b*" if it belongs to both connection point pair 1 and connection point pair 4.

Referring now to the drawings more particularly by reference numbers, wherein like numbers identify like items, number 20 in FIG. 1 identifies a vending control system for a multi-channel vendor wherein each channel may have a separate vend price associated therewith. Typically, each vend channel of the vendor will have one or more vend selections associated therewith, and all the vend selections belonging to a particular vend channel will be priced the same. For example, a four channel vendor may be arranged to include a first channel, designated as channel 1, which has three vend selections associated therewith, designated as selections 1-1, 1-2, and 1-3, each of which vend selections has a vend price of seventy-five cents; a second channel, designated as channel 2, which has two vend selections associated therewith, designated as selections 2-1 and 2-2, each of which has a vend price of thirty-five cents; a third channel, designated as channel 3, which has four vend selections associated therewith, designated as selections 3-1, 3-2, 3-3, and 3-4, each of which has a vend price of fifty cents; and a fourth vend channel, designated as channel 4, which has a single vend selection associated therewith, designated as 4-1, which selection has a vend price of eighty-five cents. Thus, for such vendor the vend price associated with channel 1 would be seventy-five cents, with channel 2 would be thirty-five cents, with channel 3 would be fifty cents, and with channel 4 would be eighty-five cents. For convenience and ease of description, the foregoing vendor example will be utilized at various times in what follows in explaining the operation of the present invention.

The vending control system 20 includes a master control means 22, credit entry means 24 for receiving credit entries and for communicating information regarding such credit entries over a data path 26 to the master control means 22, vendor status means 28 for detecting various vendor status information and for communicating information over a data path 30 to master control means 22, delivery control means 32, including a plurality of vend delivery means, connected via a signal pathway 34 to receive information from selection means 36, and a data path 38 for communicating vend channel authorization signals from the master control means 22 to the delivery control means 32. Also included in such vending control system is a vend energization monitor means 40, which monitor means is connected in series circuit through lead 41 with and through delivery control means 32 between power connectors PL1 and PL2 to detect the energization of any vend delivery means and to produce a vend energized signal in response thereto, a path 42 for communicating the vend energized signal to master control means 22, vend completion detector means 44 for detecting a vend delivery, and vend delivery monitor means 46 for producing a vend completion signal which may be provided via a signal path 48 to the master control means 22 at the conclusion of a vend operation. Payout control means 50 may also be optionally provided and may be connected via signal pathways 52 and 54 to master control means 22 to receive payout authorization information therefrom and to provide payout delivery information thereto.

It should be appreciated that the master control means 22 of the present invention may include either hardwired components or a programmed microprocessor for effecting operational control, as will become more apparent hereinafter, wherein a detailed description of one possible embodiment of a master control means will be presented. As will be further explained in what follows, the master control means 22, when operating in its normal vending mode, compares, in sequence, the total credit entered by the customer against the particular vend price associated with each channel of a multi-channel vendor. As each such comparison is made, if the total credit entered equals or exceeds the vend price for such channel, a vend channel authorization signal identifying such channel as an approved vend channel is produced on data path 38. If the total credit entered is insufficient for the vend channel whose vend price is undergoing comparison, no vend channel authorization signal is produced.

As each vend channel authorization signal identifying an approved vend channel is generated by the master control means 22, it is communicated via data path 38 to delivery control means 32. If the customer has already made a vend selection by actuating selection means 36, thereby enabling selection information to be communicated to delivery control means 32 via signal pathway 34, and if such vend selection information identifies a vend selection which belongs to the vend channel for which a vend channel authorization signal is then being produced by master control means 22, vend circuit completion is effected in delivery control means 32 to and through an appropriate vend delivery means, thereby initiating a vend delivery operation. Such circuit completion also effects completion of a series circuit between power connectors PL1 and PL2 through the vend energization monitor means 40 as a result of which such monitor means 40 produces a vend energized signal which is provided via path 42 to master control means 22. Upon the receipt by master control means 22 of such vend energized signal, further comparison operations by the master control means 22 are inhibited and the vend channel authorization signal then being produced is locked ON for a period sufficiently long enough to effect a full operation of the appropriate vend delivery means.

If no vend selection information is available, as would be the case if no vend selection had yet been made by the customer, or if the vend selection information available identifies a vend selection which does not belong to the vend channel for which a vend channel authorization signal is then being produced by master control means 22, no vend circuit completion will be realized, the vend energization monitor means will therefore not produce a vend energized signal, and the master control means 22 will consequently continue with its sequenced comparison operations.

By way of example, and with reference to the vendor previously described, in a situation where a customer has deposited a total of sixty cents and has operated selection means 36 to select a vend selection 3-2, master control means 22 will, without reference to the selection made, begin a sequential comparison mode of operation in which it will first compare the sixty cent credit entry against the seventy-five cent vend price that has been established for channel 1. Master control means 22 will not produce any vend channel authorization signal for channel 1, though, since the vend price associated therewith is greater than the credit entry. Since master control means 22 will therefore receive no vend energized signal indicating that a vend circuit has been established, it will proceed in its normal course of operation to next compare the sixty cent credit entry against the thirty-five cent vend price for channel 2, and will produce a vend channel authorization signal for channel 2 since the credit entry exceeds the vend price therefor. Such vend channel authorization signal will be provided over data path 38 to delivery control means 32, but no vend circuit will be completed since vend selection 3-2 which has been selected by the customer belongs to vend channel 3 and not to vend channel 2. Consequently, no vend energized signal will be produced and communicated to master control means 22, and, in the absence of such a signal, master control means 22 will proceed in its normal course of operation to next compare the sixty cent credit entry against the fifty cent vend price for channel 3 and to produce a vend channel authorization signal for channel 3. When such vend channel authorization signal is communicated over data path 38 to delivery control means 32, delivery control means 32 will respond to the simultaneous occurrence of a channel 3 vend channel authorization signal and to selection information provided over signal pathway 34 identifying the vend selection made—selection 3-2—as a selection from vend channel 3 to complete a vend circuit to and through the particular vend delivery means associated with vend selection 3-2. The completion of such vend circuit effects a circuit completion through vend energization monitor means 40, wnich results in the production of a vend energized signal that is communicated to master control means 22 over signal path 42. Such vend energized signal causes master control means 22 to cease further sequencing and to maintain the vend channel authorization signal then being produced for vend channel 3 for a sufficiently long enough period for the vend delivery means associated with vend selection 3-2 to fully operate.

A preferred form of the present invention employs a vend delivery monitor means 46 which is responsive to an appropriate event occurrence, such as the opening or closing of a cam operated switch associated with a vend delivery motor, the passage of a product over or past a vend delivery switch or detector, or the timing out of a timer, for producing a vend completion signal that is communicated via a signal path 48 to master control means 22. Examples of circuits which may be employed to generate vend completion signals may be found in U.S. Pat. Nos. 3,841,456; 3,894,220; 4,008,792; 4,359,147; and U.S. patent application Ser. No. 283,656, filed July 15, 1981, all assigned to Applicant's assignee. As will be further explained hereinafter, the master control means 22 may be designed to be responsive to receipt of a vend completion signal on lead 48, which signal may be either a HI or LO signal, or the transition from one state to another, depending upon the construction of the master control means 22, to condition the vend control system for subsequent vend and/or service mode operations.

ILLUSTRATIVE DELIVERY CONTROL MEANS AND SELECTION MEANS

It should be appreciated that a variety of delivery control means and selection means can be employed in vending control systems that utilize the subject invention, and FIGS. 2–5 depict several illustrative embodiments of delivery control means and selection means that may be advantageously employed in the vending control system of FIG. 1. For example, in FIG. 2 the delivery control means 32 includes gating elements 80, 82, and 84, all of which are designed to be connected in common through lead 41 to the vend energization monitor means 40, and vend motors 90–95 connected to appropriate ones of the gating elements 80, 82, and 84. It will be obvious to those skilled in the art that such gating elements may take many forms, a few of which will be described in further detail in that which follows. The selection means 36 includes selection switches 100–105 whose normally open contacts are connected, respectively, to vend motors 90–95, and whose common terminals are operatively connected in the daisy-chain arrangement shown through closed switch 107, the purpose of which will be explained further hereinafter, to power connector PL2. In the depicted embodiment, data path 38 includes leads **38*a*, 38*b*, and 38*n* connected, respectively, to gating inputs 81, 83, and 85 of gating elements 80, 82, and 84**.

Figure 2:
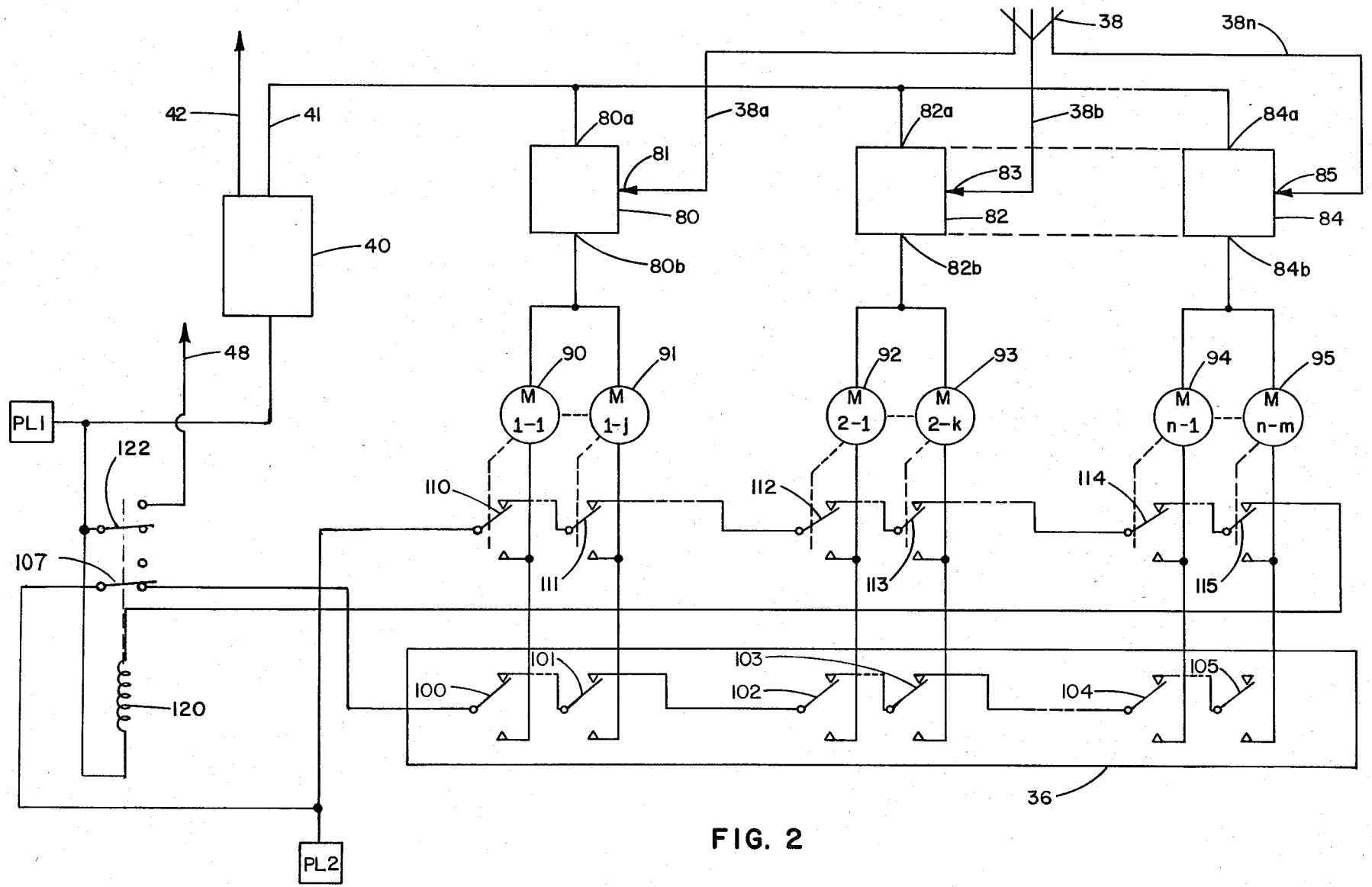
FIGS. 2–5 depict in more detail several illustrative embodiments of delivery control means and selection means that may be employed in FIG. 1.

It will be appreciated that each of the gating elements 80, 82, and 84 is associated with a separate vend channel and that, with the embodiment of FIG. 2, master control means 22 is designed to produce a vend channel authorization signal on an appropriate one of the vend leads of data path 38 whenever a comparison being made by the master control means 22 indicates that sufficient credit has been entered to permit vending of an article or product of the vend channel whose price is undergoing such comparison. Consequently, if gating element 80 is the gating element for channel 1, gating element 82 is the gating element for channel 2, and gating element 84 is the gating element for channel 3 (wnen n=3), wherein the vend selections associated with such channels have the respective vend prices previously discussed, when a customer has deposited a total of sixty cents and has operated selection switch 105, master control means 22 will initially, without reference to any particular vend selection, compare the sixty cent credit entry against the seventy-five cent vend price for channel 1, but will not produce any vend channel authorization signal on lead **38*a* since the vend price associated therewith is greater than the credit entry. Since master control means 22 receives no vend energized signal indicating that a vend circuit has been established, it will proceed to next compare the sixty cent credit entry against the thirty-five cent vend price for channel 2, and will produce a vend channel authorization signal on lead 38*b* since the credit entry exceeds the vend price associated therewith. Such vend channel authorization signal will be provided to gating input 83 of gating element 82 to permit circuit completion between gate terminals 82*a* and 82*b* of gating element 82. Despite such circuit completion through gating element 82, no vend circuit will be completed through either of vend motors 92 or 93 since neither of selection switches 102 or 103 has been actuated by the customer. Consequently, no vend energized signal will be produced and communicated to master control means 22, and, in the absence of such signal, master control means 22 will proceed to next compare the sixty cent credit entry against the fifty cent vend price for channel 3. Since the credit entry exceeds the vend price for channel 3 a vend channel authorization signal will be produced on lead 38*n* and provided to gating input 85 of gating element 84 to effect circuit completion between gate terminals 84*a* and 84*b*. Since selection switch 105 has been actuated and is in its transferred position at the same time as the circuit completion between gate terminals 84*a* and 84*b* is effected, a circuit will be completed from power connector PL1 through vend energization monitor means 40, lead 41, gating element 84, vend motor 95, transferred selection switch 105, non-transferred selection switches 100–104, and closed switch 107 to power connector PL2, thereby causing vend motor 95 to be energized and to begin to operate. As a result of such circuit completion, vend energization monitor means 40 will produce a vend energized signal that will be communicated over signal path 42 to master control means 22, the effect of which is to cause master control means 22 to cease further sequential comparisons and to maintain the vend channel authorization signal then being produced on lead 38*n* for a sufficiently long enough period for vend motor 95** to operate.

The delivery control means 32 of FIG. 2 also includes motor hold circuitry to ensure that power will be maintained to the energized vend motor for a sufficiently long enough period to permit complete operation of the motor and for controlling operation of vend delivery monitor means 46, even if the actuated selection switch returns to its non-transferred position prior to the completion of vend cycle operation of the energized vend motor. Such circuitry includes motor hold switches 110–115, whose normally closed contacts are connected in a daisy-chain arrangement, as shown, through succeeding switches' normally closed contacts and vend delivery relay 120 to power connector PL1; whose respective normally open contacts are connected in series circuit with respective vend motors 90–95; and whose common terminals are connected in the daisy-chain arrangement shown through preceding switches' normally closed contacts to power connector PL2. Such motor hold switches 110–115 are cam operated switches, each of which is caused to cycle from its normally non-transferred to a transferred state and back to its non-transferred state during a complete operation of the respective vend motor with which it is associated. Thus, when vend motor 95 is energized and begins to operate, a cam associated therewith causes motor hold switch 115 to move from its non-transferred position to a transferred position in order to maintain power to and through such motor for a sufficiently long enough period to cause it to fully cycle. Upon the conclusion of the vend motor's cycle, the cam associated therewith causes switch 115 to move from its transferred back to its non-transferred condition.

In the noted embodiment, vend energization relay 120 is normally energized causing relay contact 107 to be held closed and relay contact 122 to be held open. Whenever any cam operated switch 110–115 is thereafter moved to its transferred position, the circuit through relay 120 is broken and such relay becomes de-energized, which de-energization allows relay contact 107 to open and relay contact 122 to close. The opening of relay contact 107 breaks the circuit through selection switches 100–105 so that, for the duration of the pending vend operation, further actuation of such switches will be of no effect and continued vend motor operation will be under control of motor hold switches 110–115. The closure of relay contact 122 completes a circuit from power connector PL1 to lead 48 and thus permits a signal application from power connector PL1 to master control means 22. The movement of such cam operated switch back to its non-transferred condition at the conclusion of an operational cycle of its associated vend motor re-establishes the circuit through vend energization relay 120, thereby re-energizing such relay and causing the power signal provided to lead 48 from power connector PL1 to be removed due to the re-opening of relay contact 122. In this instance, the master control means employed would be designed to be responsive to such latter change of signal on lead 48, denoting vend completion, to re-initialize and condition the vending control system for subsequent vend and/or service mode operations.

Figure 3:
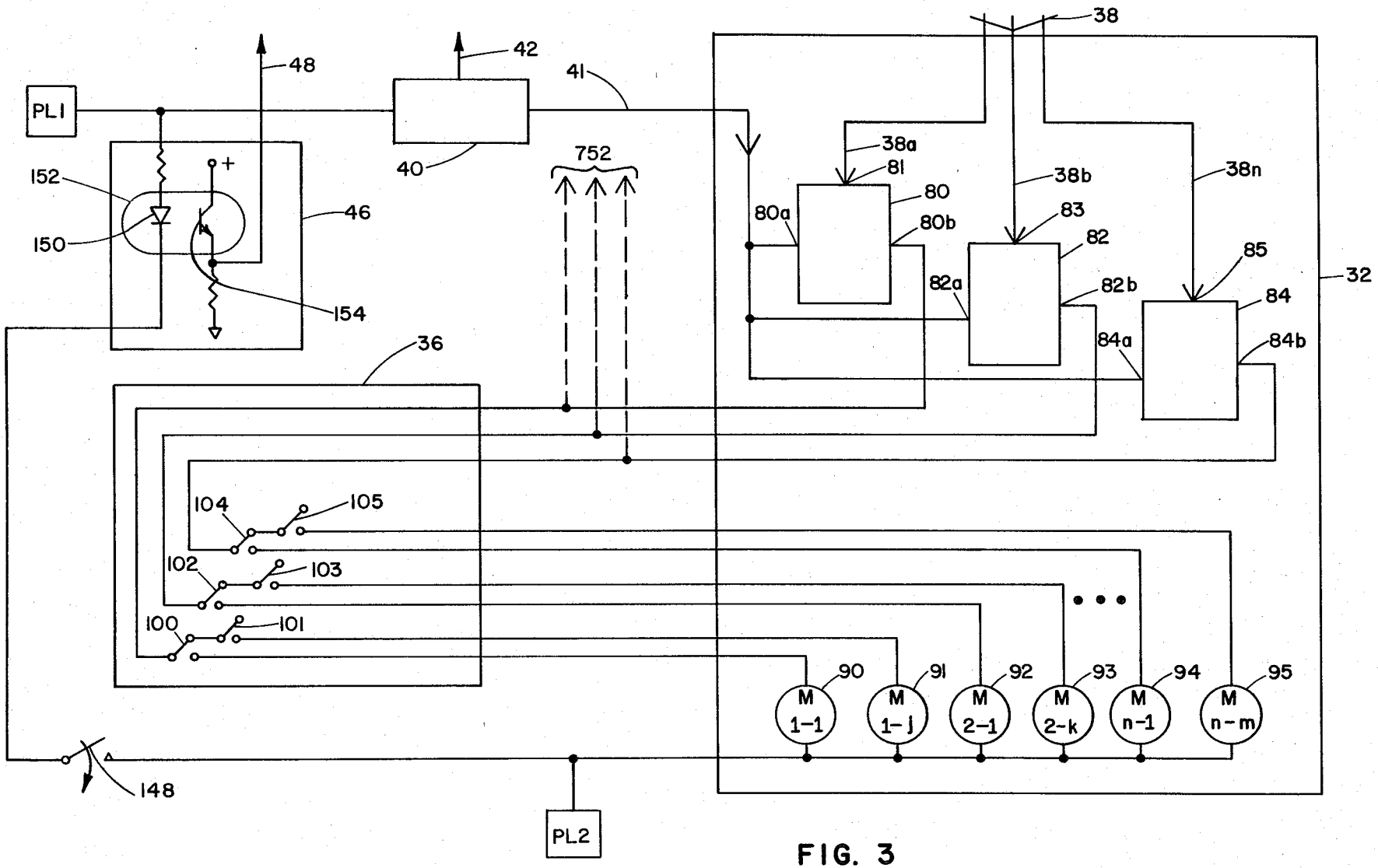

FIG. 3 depicts another embodiment of delivery control means and selection means that may be utilized in a vending control system that employs the subject invention. Many of the elements depicted in the FIG. 2 embodiment are found in the FIG. 3 embodiment, but connected in a different circuit arrangement, and a different vend completion monitor means is employed. For purposes of simplification, no motor hold circuitry is depicted in the FIG. 3 embodiment, although it will be apparent to those skilled in the art that such circuitry could be readily employed in such embodiment as well as in the FIG. 2 and other vend delivery control circuit embodiments. In light of what has already been described with respect to the FIG. 2 embodiment, the operation of the FIG. 3 embodiment will be obvious to one skilled in the are and need not be discussed in minute detail. It should be noted, however, that in the FIG. 3 embodiment delivery completion is detected in a somewhat different manner by a delivery sensor means located on the vending machine and positioned to respond to the occurrence of any vend delivery. Such delivery sensor means may take any of a variety of forms and is depicted in FIG. 3 as a normally open switch 148 which closes whenever a product being delivered passes thereover or thereby. When delivery sensor switch 148 is in its normally open position, no circuit completion through photodiode 150 is effected, and photodiode 150 is therefore de-energized, as a result of which phototransistor 154 is not conducting, and a LO signal is maintained on lead 48. When delivery sensor switch 148 thereafter momentarily closes as a result of vend delivery, a circuit is established from power connector PL1 through photodiode 150 of optical coupler 152 and through switch 148 to power connector PL2, as a consequence of which photodiode 150 conducts and so causes phototransistor 154 to turn ON thus producing a HI signal on lead 48. Such HI signal on lead 48 signals master control means 22 that vend completion has occurred, and master control means 22 responds thereto, as will be discussed in more detail hereinafter, to re-initialize and condition the vending control system for subsequent vend and/or service mode operations.

Figure 4:
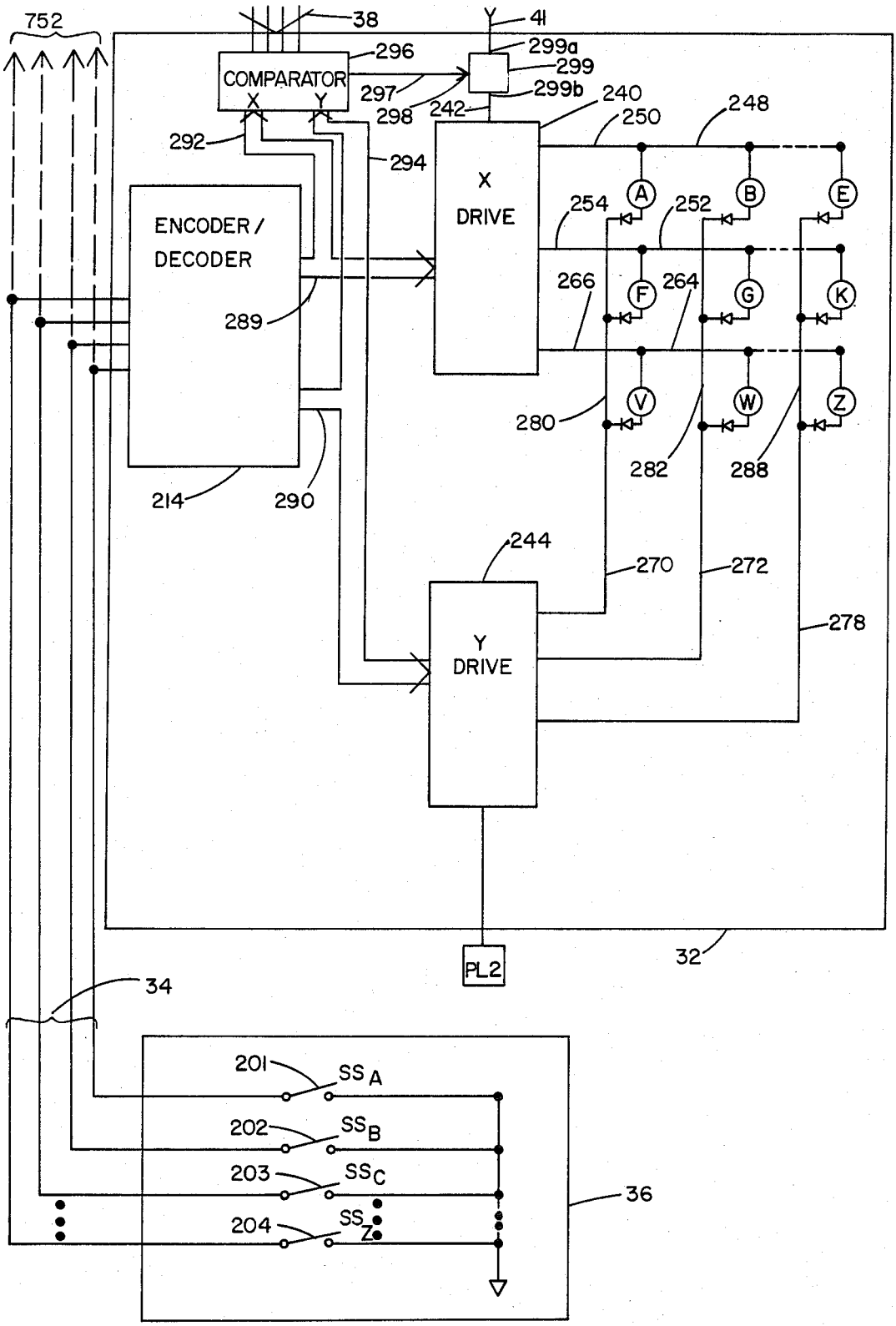

FIG. 4 depicts a still further embodiment of delivery control means and selection means which may be employed with the present invention, and especially with a master control means which provides binary coded vend channel authorization signals over data path 38. Those elements numbered 214 through 288 in FIG. 4 correspond generally to elements labelled 14 through 88, respectively, in FIG. 1 of U.S. Pat. No. 4,284,208, assigned to Applicant's assignee, the function and operation of which are clearly described in such patent. Selection switches 201–204 are connected via data path 34 to an encoder/decoder means 296 which detects actuation of a selection switch and assigns a particular X, Y code thereto. The X component is provided via data path 289 to X drive means 240 and the Y component is provided via a data path 290 to Y drive means 244 for use in effecting the energization of a particular vend motor associated with the vend selection selected by the customer. Such X and Y signals are also provided via respective data paths 292 and 294 to a comparator means 296 which is connected to also receive the binary coded vend channel authorization signals produced on data path 38. If the particular binary coded vend channel authorization signal provided to comparator means 296 on data path 38 corresponds to the vend selection denoted by the X, Y signals then being provided to the comparator means 296 over the data paths 292 and 294, comparator means 296 will generate an enable signal which will be provided over lead 297 to gating input 298 of a gating element 299 whose input terminal **299*a* is connected to lead 41 and whose output terminal 299*b* is connected via lead 242 to X drive means 240. Unless gating element 299 is gated ON by an enable signal generated by comparator means 296 and communicated to gating input 298 of gating element 299, the power applied from power connector PL1 through vend energization monitor 40 and lead 41 will not be gated through gating element 299 to energize an appropriate vend motor A–Z. When gating element 299 is gated ON, such power will be gated to X drive means 240, and X drive means 240 and Y drive means 244 will respond to the X and Y signals present, respectively, on data paths 289 and 290 to energize a respective one of the vend motors A–Z in the manner which is described in U.S. Pat. No. 4,284,208. As X drive means 240 and Y drive means 244 operate to energize a vend motor, a circuit will be completed from power connector PL1 through vend energization monitor means 40, lead 41, gated ON gating element 299, lead 242, X drive means 240, the appropriate vend motor A–Z, and Y drive means 244 to power connector PL2. As a result of such circuit completion, vend energization monitor means 40 will produce a vend energized signal that will be communicated over signal path 42 to master control means 22, the effect of which is to cause master control means 22 to cease further sequential comparisons and to maintain the vend channel authorization signal then being produced on data path 38**.

Figure 5:
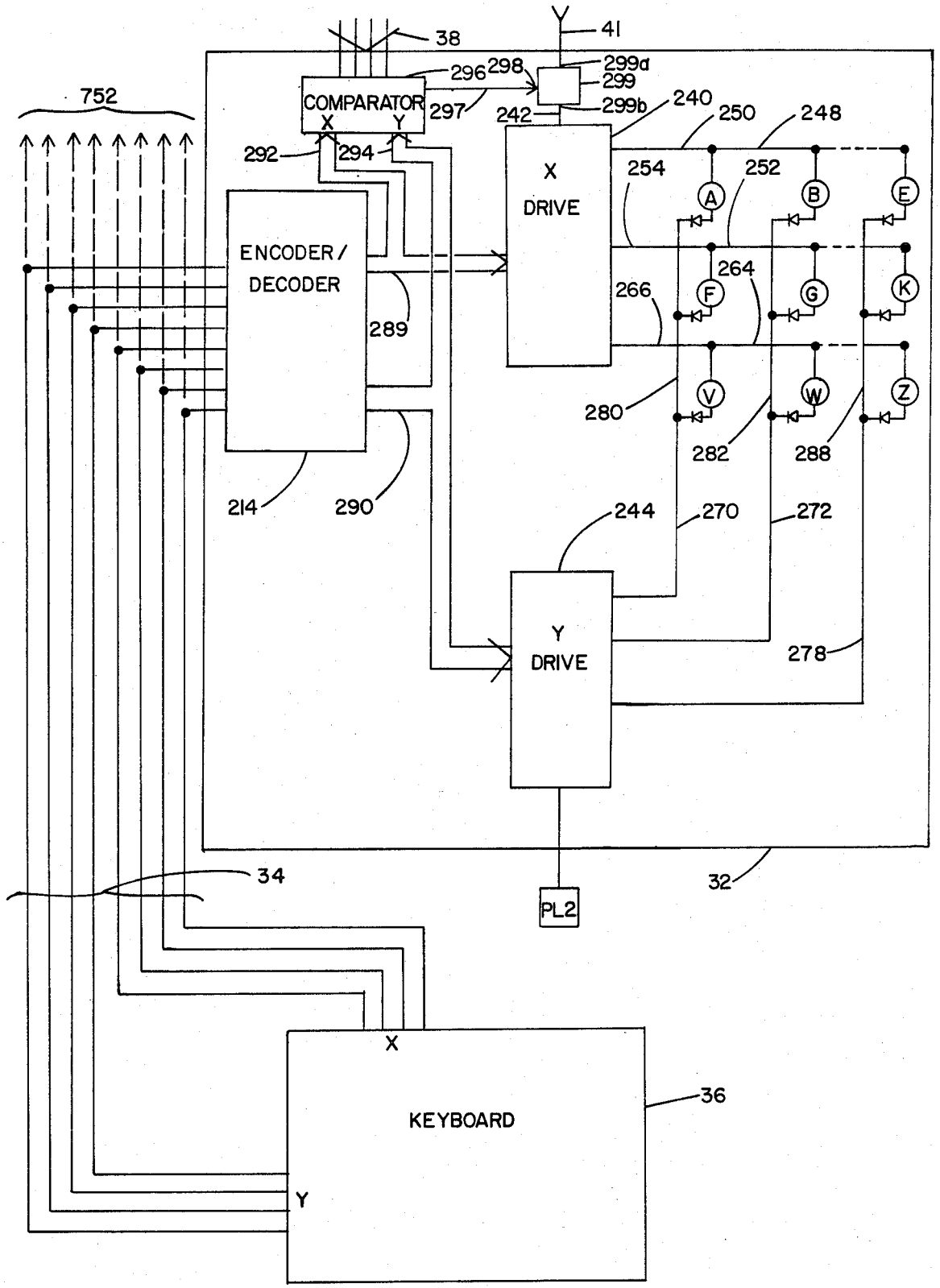

The circuit depicted in FIG. 5 is similar in many respects to that of FIG. 4, but the selection means 36 includes a keyboard which can be used for selecting a product to be vended by any of the vend motors A–Z. In view of the discussion already presented with respect to the embodiment of FIG. 4, the operation of the circuitry of FIG. 5 will be obvious to a person skilled in the art.

From the foregoing, it will be appreciated that the subject invention may be employed with a variety of delivery control means and selection means, and it will thus be apparent that the subject invention is adaptable for use with many different types of multi-channel vending machines. It should also be readily apparent that, regardless of the particular delivery control means and selection means employed, the subject invention requires only a single vend energization monitor means instead of the multitude of vend selection monitor means which would otherwise be required for multi-channel vend applications. Consequently, circuit replication, which would otherwise be required for each vend channel, is minimized, and it becomes possible to greatly reduce, especially for a numerous channel vendor, the number of interface connectors that are required between the vendor and the control circuit package.

DETAILED EMBODIMENTS

Referring now to FIGS. 6–10 which depict in greater detail a particular circuit embodiment of FIG. 1, the master control means 22 includes a vend processor means 300, channel scanning control means 314, price entry means 330, vend/payout select control means 346, and interconnecting and related circuitry. Vend processor means 300 is a central processing means for the master control means and is connected to receive data over data paths 26, 30, and 54 from, respectively, the credit entry means 24, the vendor status means 28, and the payout control means 50. Vend processor means 300 also includes a variety of other input and output connections, the function and importance of which will be explained hereinafter. Such vend processor means 300 is responsive to credit entry signals received over data path 26 from credit entry means 24 to accumulate the total credit entered, and is responsive to other stimuli to effect entry and storage of particular vend channel vend prices during a service mode of operation and to effect comparison of total credit entered against the stored pre-established vend channel vend prices preparatory to the generation of vend channel authorization signals over data path 38 from master control means 22 to delivery control means 32 during a vend mode of operation, as will be explained.

The channel scanning control means 314 includes circuitry for effecting and controlling during a service mode of operation the entry of vend channel vend price information into the vend processor means 300 and for controlling during a normal vend mode of operation the scanning of the various vend channels until recognition of energization of the vend motor associated with the vend selection selected. As will be further explained with reference to FIG. 8, such means also provides a timing signal over lead $\tau$ to the vend processor means 300 and to the price entry means 330 to ensure properly timed interaction therebetween.

Figure 6:
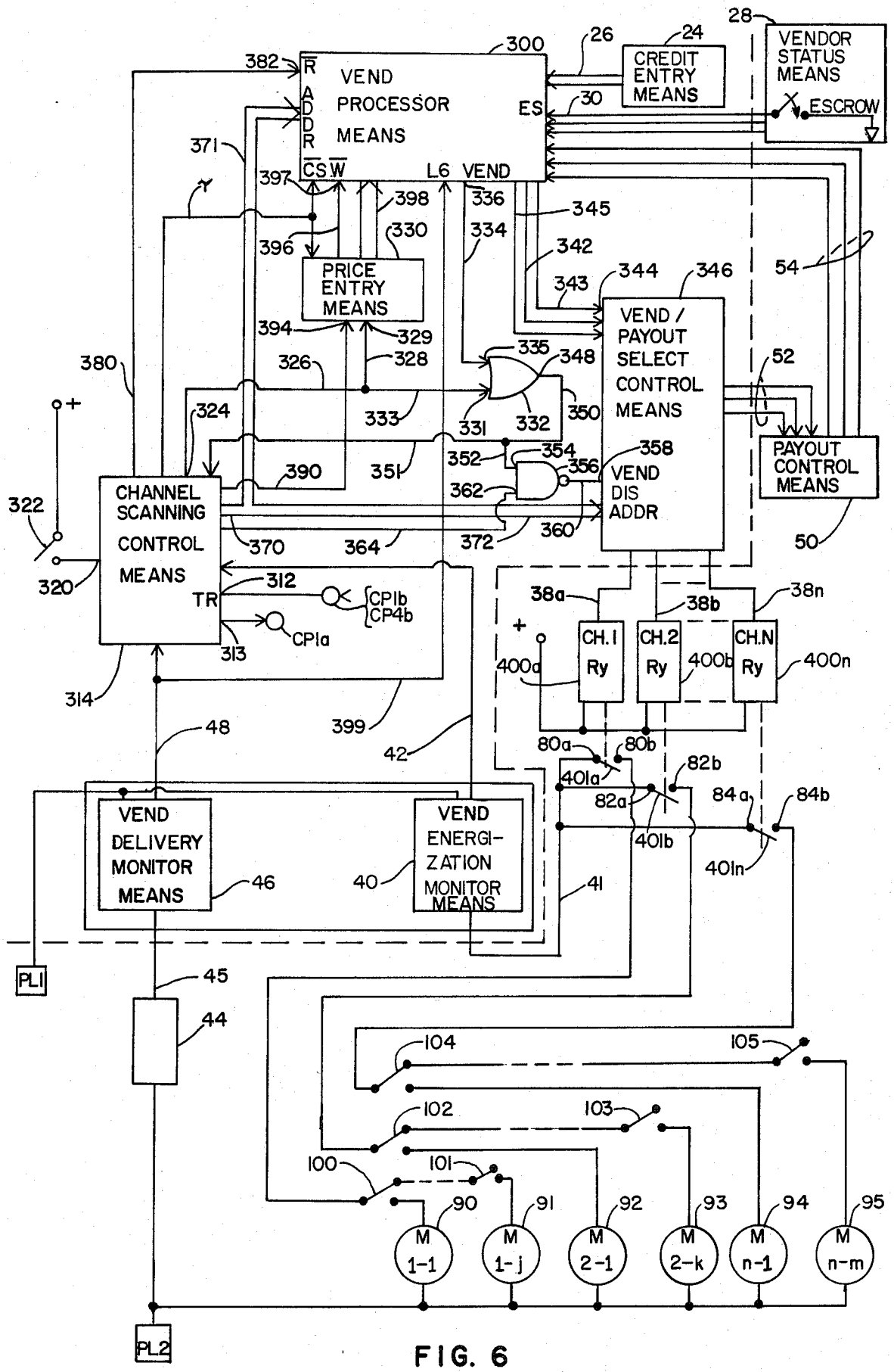
FIG. 6 depicts in greater detail a particular embodiment of the vending control circuit of FIG. 1.

The channel scanning control means embodiment depicted in FIG. 6 includes a TR trigger input 312 connected to connection point CP1*b* (also identified as CP4*b*), and a trigger output 313 connected to connection point CP1*a*. As will be discussed more fully hereinafter, especially with respect to FIG. 8, such elements may be employed in various, alternative methods of triggering the channel scanning control means to initiate the operation thereof.

Channel scanning control means 314 further includes a price arming input 320 that is connected to the normally open contact of a price arming switch 322, the common of which switch is connected to a positive voltage source. Such control means 314 has a first output 324 connected via leads 326 and 328 to price entry means 330, which output is also connected via leads 326 and 333 to the first input 331 of an OR gate 332, the other input 335 of which is connected via lead 334 to vend output 336 of vend processor means 300. The output 348 of OR gate 332 is provided via leads 350 and 351 back to channel scanning control means 314 and also via leads 350 and 352 to a first input 354 of NAND gate 356, the output of which is provided to a vend disable input 358 of vend/payout select control means 346 over lead 360. The other input 362 of NAND gate 356 is connected to lead 364 from the channel scanning control means 314.

Channel address information identifying a particular vend channel is provided from channel scanning control means 314 over data paths 370 and 371 to vend processor means 300 and over data paths 370 and 372 to vend/payout select control means 346. The information provided over such data paths is utilized by the vend processor means 300 during a service mode of operation to effect storage of vend channel vend prices in vend processor means 300 and during a normal vend mode of operation for retrieval for comparison purposes of appropriate vend channel vend prices. The vend/payout select control means 346 utilizes such channel address information in the generation of appropriate vend channel authorization signals on leads 38*a*–38*n*, as will be more fully explained in what follows.

As will be discussed in further detail hereinafter, channel scanning control means 314 is capable of generating a read signal during a normal vend mode of operation, which read signal is communicated over lead 380 to $\overline{R}$ read input 382 of vend processor means 300 to effect retrieval by such vend processor means 300 of a vend price for the vend channel whose channel address information is then being provided to vend processor means 300 over data paths 370 and 371. Channel scanning control means 314 is also capable of generating a price entry signal during a service mode of operation when appropriate conditions for price entry are realized, which signal is provided over a lead 390 to input 394 of price entry means 330. Upon the simultaneous occurrence of a price arming signal at input 329 of the price entry means 330 and a price entry signal at input 394 of the price entry means 330, price entry means 330 generates both a write signal which is provided over a lead 396 to $\overline{W}$ write input 397 of vend processor means 300 and price information which is provided over a data path 398 to vend processor means 300. As will be explained, the occurrence of a write signal at input 397 of vend processor means 300 will cause the price information available on data path 398 to be stored at a location corresponding to the channel address information provided on data paths 370 and 371.

It should be appreciated that when the master control means 22 has been reset prior to initiation of a service or vend operation, LO signals will normally be present on payback leads 342, 343, and 345 from vend processor means 300, as well as at vend output 336. At such time the signals on leads 326, 364, and 390 from channel scanning control means 314 will also be LO while the signal on lead 380 will be HI. As a consequence thereof, the signal provided over lead 396 from price entry means 330 to $\overline{W}$ write input 397 of vend processor means will be LO, the output 348 of OR gate 332 will be LO, and a HI signal will therefore be provided to vend disable input 358 of vend/payout select control means 346 to ensure that no vend channel authorization signals will be produced on any of vend channel authorization leads 38*a*–38*n*.

Figure 8:
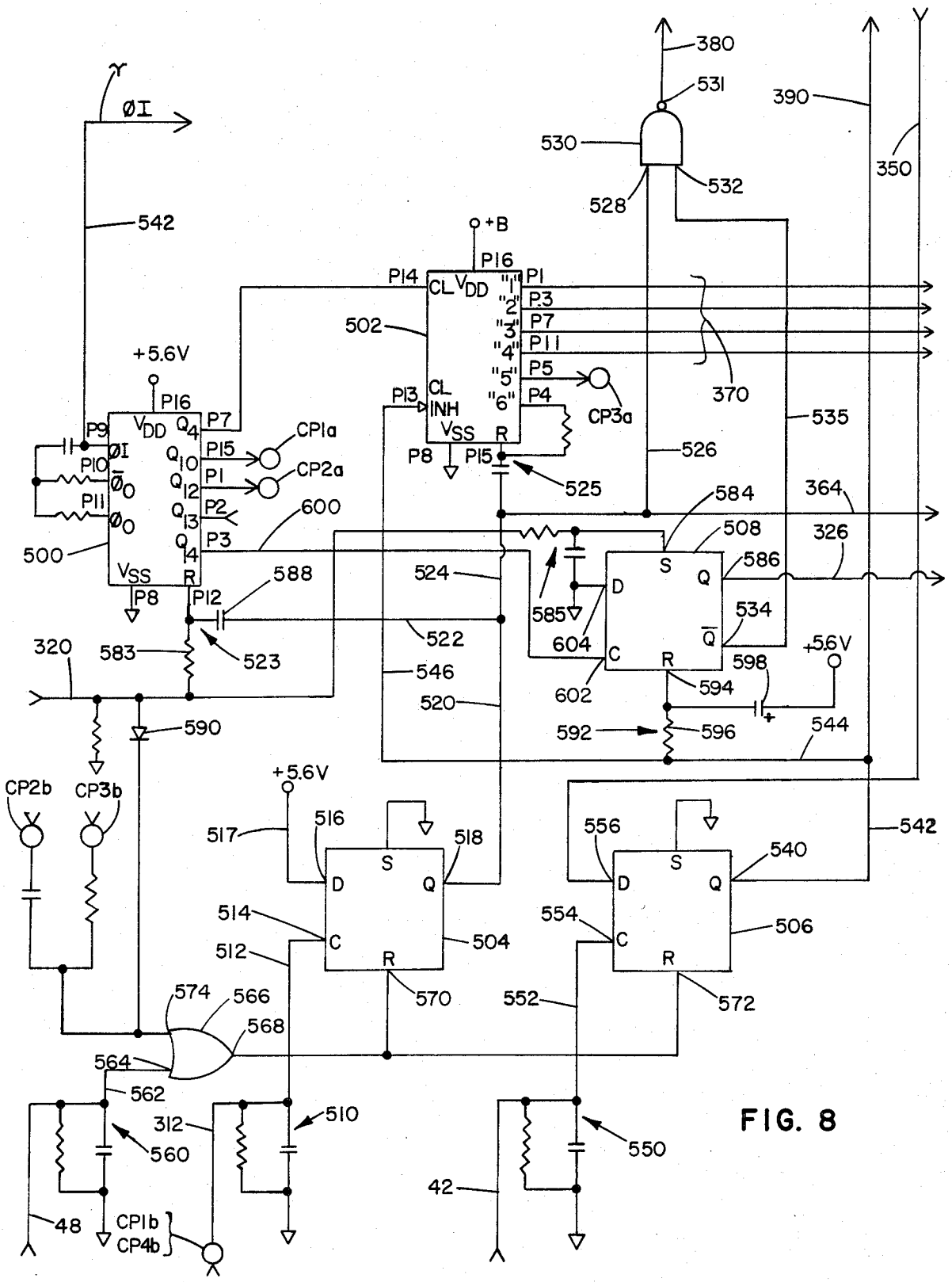
FIG. 8 depicts a particular embodiment that may be utilized as the channel scanning control means of FIG. 6.

As will be more fully explained hereinafter, the operation of channel scanning control means 314 can be initiated, when in a normal vend mode of operation, either by an internal clock or by application of an external trigger signal to TR trigger input 312, and when in a service mode of operation, by actuation of price arming switch 322. The channel scanning control means 314 of FIG. 6, which will be described in greater detail hereinafter with respect to FIG. 8, is specifically designed to permit it to be employed not only for vend control purposes, but also for price entry purposes. In view of this, the optional manner in which vend channel vend prices may be established for use in vending operations will be described first, following which there will be presented a description of a typical vend operation.

VEND CHANNEL VEND PRICE ENTRY

When the vend control circuit is placed in a service mode of operation, it is possible for a serviceman to enter and establish vend prices for all or selected ones of the vend channels. The serviceman accomplishes this by actuating price arming switch 322, thereby resulting in the application of a HI signal to input 320 of channel scanning control means 314. When the HI signal is applied at input 320 of channel scanning control means 314 due to the actuation of price arming switch 322, such control means also effects the generation of a HI signal at output 324 thereof, which HI signal is communicated via leads 326 and 328 to input 329 of price entry means 330 and via leads 326 and 333 to input 331 of OR gate 332. The occurrence of such HI signal at input 331 of the OR gate causes output 348 thereof to go HI, and such resulting HI signal is provided back to channel scanning control means 314 over leads 350 and 351 to enable vend recognition circuitry, as will be explained in greater detail hereinafter with respect to FIG. 8. Such HI signal at output 348 of DR gate 332 will also be provided over leads 350 and 352 to input 354 of NAND gate 356, whose other input 362 initially continues to be maintained LO. So long as the LO signal remains upon input 362 of NAND gate 356, the output thereof will remain HI, thus continuing to maintain a HI at vend disable input 358 of vend/payout select control means 346. When a HI signal is subsequently applied to TR trigger input 312 of channel scanning control means 314, whether as a result of internal or external triggering, both of which will be discussed in more detail hereinafter, a HI signal is generated on lead 364 and is provided to input 362 of NAND gate 356, whose other input 354 has already had a HI signal applied thereto. The simultaneous occurrence of HI signals at both of inputs 354 and 362 of NAND gate 356 results in the generation of a LO output therefrom, which LO output signal is provided over lead 360 to vend disable input 358 of vend/payout select control means 346, as a consequence of which vend/payout select control means 346 will thereafter be able, so long as the signal at vend disable input 358 remains LO, to generate a LO vend channel authorization signal on an appropriate lead 38*a*–38*n*, depending upon the channel address information being provided over data path 372.

The presence of a HI signal at input 320 of channel scanning control means 314, in addition to effecting the generation of a HI signal on lead 326, also effects the sequential generation of vend channel address information on data paths 370, 371, and 372 to vend processor means 300 and to vend/payout select control means 346. As will be discussed in more detail hereinafter, the channel address information appearing on such data paths will periodically change as channel scanning control means 314 sequentially generates address signals corresponding to and identifying each of the vend channels available.

From the foregoing, it will be appreciated that once the serviceman actuates price arming switch 322 and a trigger signal is applied to trigger input 312, channel scanning control means 314 will sequentially supply over data paths 370 and 372 to vend/payout select control means 346 vend channel address information identifying, in turn, each of the available vend channels, and the vend/payout select control means 346 will be responsive thereto to produce appropriate vend channel authorization output signals on leads 38*a*–38*n*. Thus, during a price entry operation, when channel scanning control means 314 generates an address on data path 372 corresponding to and identifying channel 1, a LO signal will be generated on lead 38*a* and communicated to channel 1 relay 400*a*, thereby completing the circuit therethrough and effecting closure of relay contact 401*a*. If the serviceman has not made any selection from channel 1, the closure of relay contact 401*a* will not result in the completion of a circuit through any of the vend motors $M_{1\text{-}1}$ through $M_{n\text{-}m}$, and channel scanning control means 314 and vend/payout select control means 346 will therefore continue with their normal operations. As channel scanning control means 314 continues its operation it will generate a new address on data paths 370 and 372 identifying channel 2, as a consequence of which vend/payout select control means 346 will operate to produce a LO signal on lead 38*b* and HI signals on the remaining leads of leads 38*a*–38*n*. The return of a HI signal upon lead 38*a* will result in the de-energization of channel 1 relay 400*a* and the deactuation of relay contact 401*a*, while the LO signal appearing on lead 38*b* will effect circuit completion through channel 2 relay 400*b*, thereby effecting actuation of relay contact 401*b*. In the absence of actuation of either of selection switches 102 or 103, no further circuit completion will be realized through any vend motor, and channel scanning control means 314 and vend/payout select control means 346 will continue their normal operations in a fashion similar to that which has already been described, as a consequence of which LO signals will continue to be sequentially, periodically generated on each of leads 38*a*–38*n* to effect closure of the appropriate relay contact 401*a*–401*n*. If, during a price entry operation, the serviceman were to actuate selection switch 104, a circuit would be completed through $M_{n\text{-}1}$ vend motor 94 when channel n relay contact 401*n* is actuated due to the generation of a LO signal on lead 38*n* from vend/payout select control means 346. The closure of channel n relay contact 401*n* at a time when switch 104 has been actuated will then result in completion of a circuit from power connector PL1 through vend energization monitor means 40, lead 41, terminal 84*a*, closed relay contact 401*n*, terminal 84*b*, closed switch 104, and $M_{n-1}$ vend motor 94 to power connector PL2. A completion of such circuit will be detected by vend energization monitor means 40 which will operate to generate a vend energized signal on lead 42 and to supply such signal thereover as an input to channel scanning control means 314.

Upon the receipt of such a vend energized signal, channel scanning control means 314 will cease further sequencing operations and will thereafter maintain the address information then being generated on data path 372 for a suitable period, as a consequence of which the LO signal being produced on lead 38*n* will be maintained LO, thereby maintaining closure of relay contact 401*n* and communication of power therethrough and through closed selection switch 104 to vend motor 94. Channel scanning control means 314 is further responsive to such vend energized signal produced on lead 42 to generate a HI signal on lead 390 and to provide such HI signal to input 394 of price entry means 330, input 329 of which has already previously, as has been explained hereinbefore, had a HI signal applied thereto.

Such price entry means 330 may include various types of price setting means, including price setting switches which may be preset by the serviceman for entry of any particular vend channel vend price, as will be explained more fully hereinafter with reference to FIG. 10. It will also be appreciated that the channel address information that is provided over data path 372 to vend/payout select control means 314 will be the same as the address information provided to vend processor means 300 over data path 371. Consequently, when channel scanning control means 346 responds to a HI vend energized signal produced on lead 42 to thereafter maintain for a suitable period the channel address information being produced, the channel address information being provided to vend processor means 300 over data path 371 will be the same as the channel address information being provided to vend/payout select control means 346 and will identify the particular vend channel with which the selection switch actuated by the serviceman is associated.

When HI signals then become simultaneously present on both of inputs 329 and 394 of price entry means 330, as has been described, such price entry means generates a price data signal which is provided over data path 398 as a data input to vend processor means 300 and also produces a write signal which is provided over lead 396 to $\overline{W}$ write input 397 of vend processor means 300, as will be more fully explained hereinafter. Vend processor means 300 will be responsive to such signals to cause the price data appearing on data path 398 to be stored at a storage location as identified by the address information appearing on data path 370.

Channel scanning control means 314 is also responsive to the vend energized signal provided over lead 42 to effect, after a suitable period of time, such as approximately 10 milliseconds, a change in the state of the signal being produced at output 324 from a HI to LO. The resulting LO output signal will be communicated from output 324 of channel scanning control means 314 via leads 326 and 328 to input 329 of price entry means 330 and via leads 326 and 330 to input 331 of OR gate 332. Since HI signals will then no longer be simultaneously present at both of inputs 329 and 394 of price entry means 330, the price entry means will be disabled and prevented from being able to perform further price entry activities.

As will be recalled, input 335 of OR gate 332 was initially LO and never changed state. Consequently, the change from a HI to LO signal at input 331 of OR gate 332 will cause output 348 of such gate to go LO, and this LO signal will be provided over leads 350 and 352 to input 354 of NAND gate 356. The occurrence of a LO signal on input 354 will cause the output of such NAND gate to go HI, resulting in the application of a HI signal to vend disable input 358 of vend/payout select control means 346, as a result of which vend/payout select control means 346 will thereafter be prevented from generating further vend channel authorization signals on leads 38*a*–38*n* until such time as the HI signal at vend disable input 358 is removed.

As a result of the above-described responses by channel scanning control means 314 to the vend energized signal provided on lead 42, price entry means 330 will simultaneously receive HI signals at inputs 329 and 394 thereof for only approximately 10 milliseconds before both the signal at input 329 goes LO and, at essentially the same time, a HI signal is applied to vend disable input 358 of vend/payout select control means 346 to prevent such control means 346 from being able to generate vend channel authorization signals. Such 10 millisecond time period, while brief, is nevertheless sufficiently long enough to allow the quick insertion of a vend channel vend price into vend processor means 300, yet short enough that the vend motor associated with the selection switch that has been actuated will not be able to operate sufficiently to vend a product. With the conclusion of a price entry operation, channel scanning control means 314 will operate, as will be further described hereinafter with respect to FIG. 8, to return the system to an initialized status and to condition the circuitry thereof to be responsive to appropriate stimuli for further price entry operations, if the system is in a service mode operation, or for vend operations, if the system enters a vending mode of operation.

VEND OPERATION

When the system functions in a vending, as opposed to service, mode of operation, price arming switch 322 remains de-actuated and channel scanning control means 314 will be triggered by either an internal clock or by an external trigger, as will be discussed in more detail in what follows, to begin to sequentially produce channel identification information on data paths 370, 371, and 372. Following the occurrence of such triggering, channel scanning control means 314 will produce a HI signal on lead 364, which signal will be provided to input 362 of NAND gate 356. Since the signal present at input 354 of such NAND gate will still be LO at such time, the output from such NAND gate 356 will not change but will remain HI. Since the output of NAND gate 356 will thus remain HI, a HI signal will continue to be applied to vend disable input 358 of vend/payout select control means 346 and such HI signal will prevent the vend/payout select control means 346 from producing any vend channel authorization signals on leads 38*a*–38*n*.

The triggering of channel scanning control means 314 by application of a HI signal to TR trigger input 312 will also result in the generation by channel scanning control means 314 of a LO signal on lead 380, which LO signal will be provided to $\overline{R}$ read input 382 of vend processor means 300. Vend processor means 300 will be responsive to such LO read signal and to the vend channel identification information being provided thereto from channel scanning control means 314 over data path 371 to retrieve the particular vend price that has been established for the channel whose identification is being provided over data path 371 and to effect a comparison between such vend price and the total credit entered.

If such vend price is geater than the total credit entered, no vend approval signal will be generated, and vend output 336 of vend processor means 300 will therefore remain LO. On the other hand, if the total credit entered is greater than or equal to the vend price for the vend channel under consideration, vend processor means 300 will produce a HI signal at vend output 336, which HI signal will be communicated over lead 334 to input 335 of OR gate 332. The occurrence of the HI signal at input 335 of OR gate 332 will cause the output 348 thereof to also go HI and such HI output signal will be communicated over leads 350 and 352 to input 354 of NAND gate 356. Since the signal present at input 362 of NAND gate 356 will already have gone HI, as previously described, the output of such NAND gate will change from a HI to a LO signal. Such LO signal will be applied over lead 360 to vend disable input 358 of vend/payout selection control means 346 and will thus remove the HI vend disable signal otherwise present, thereby permitting such control means 346 to generate a vend channel authorization signal on an appropriate one of leads 38*a*–38*n*, depending upon the vend channel identification information being provided over data path 372.

If, for example, information identifying vend channel 2 is available on data paths 370–372, and the total credit entered by the customer equals or exceeds the vend price, a vend approval signal will be generated at vend output 336 of vend processor means 300, resulting in generation of a LO vend channel authorization signal on lead 38*b*. The occurrence of such LO signal on lead 38*b* will cause channel 2 relay 400*b* to become energized, thereby causing channel 2 relay contact 401*b* to close. If the customer has not made a selection associated with vend channel 2, such as by actuating vend selection switch 102 or 103, no vend motor will become energized. In such event, channel scanning control means 314 will continue with its sequential production of vend channel identification information on data paths 370–372, and vend processor means 300 and vend/payout select control means 346 will be responsive thereto to generate vend channel authorization signals as appropriate on respective ones of the leads 38*a*–38*n* when the total credit entered equals or exceeds the vend price for the channel currently being identified on data paths 370–372.

If, at the time a LO vend channel authorization signal nas been generated on lead 38*b*, a customer has actuated a vend selection switch associated with vend channel 2, such as vend selection switch 103, the resulting closure of relay contact 401*b*, in conjunction with the actuation of vend selection switch 103, will complete a circuit from power connector PL1 through vend energization monitor means 40, terminal 82*a*, closed contact 401*b*, terminal 82*b*, actuated vend selection switch 103, and $M_{2\text{-}k}$ vend motor 93 to power connector PL2, thereby energizing vend motor 93. As a consequence of such circuit completion, vend energization monitor means 40 will produce a vend energized signal on lead 42 and provide such signal to channel scanning control means 314. Channel scanning control means 314 will be responsive to such vend energized signal to terminate further scanning operations and to maintain the vend channel information then being produced on data paths 370–372 for a sufficiently long enough period to permit vend motor 93 to operate. As product delivery occurs, such delivery will be detected by vend delivery detector means 44 to complete a circuit therethrough and through vend delivery monitor means 46. Vend delivery monitor means 46 will be responsive to such circuit completion to produce a vend completion signal which will be provided to channel scanning control means 314 over lead 48 and to vend processor means 300 over leads 48 and 399.

Channel scanning control means 314 will be responsive to such vend completion signal to effect a re-initialization of its circuitry and to cause the output signal present on lead 364 to return from a HI to an initialized LO state. The resulting LO signal, which is applied to input 362 of NAND gate 356, will cause the output of such NAND gate to return HI, as a result of which vend/payout select control means 346 will again be prevented from generating any further vend channel authorization signals on any of leads 38*a*–38*n*.

Vend processor means 300 is responsive to the vend completion signal provided over lead 399 to the L6 input thereof to effect the payback of any excess credit and to thereafter re-initialize its circuitry for subsequent service or vending operations. If payback operations are required, vend processor means 300 will produce appropriate payback signals on leads 342 and 343 and vend/payout select control means 346 will be responsive thereto to generate appropriate outputs on data path 52. Payout control means 50 is responsive to such signals to effect payback and to provide certain information regarding payback back to vend processor means 54. Circuitry for effecting and controlling payback operations is well known in the art and further discussion thereof need not be presented. Typical of the circuitry that may be employed are payback circuits disclosed and described in U.S. Pat. Nos. 3,687,255; 3,820,642; 3,894,220; 3,841,456; 3,963,035; and 4,008,792, all of which are assigned to Applicant's assignee.

It will be appreciated by those skilled in the art that various circuit constructions that do not depart from the spirit or scope of the subject invention, including various circuit embodiments of vend energization monitor means means 40, vend delivery monitor means 46, channel scanning control means 314, vend processor means 300, price entry means 330, and vend/payout select control means 346, could be advantageously employed to accomplish the various functions hereinabove described. However, in that which follows there are presented representative examples of circuit constructions that have been found particularly well adapted for use in or with the subject invention.

MONITOR MEANS

Figure 7:
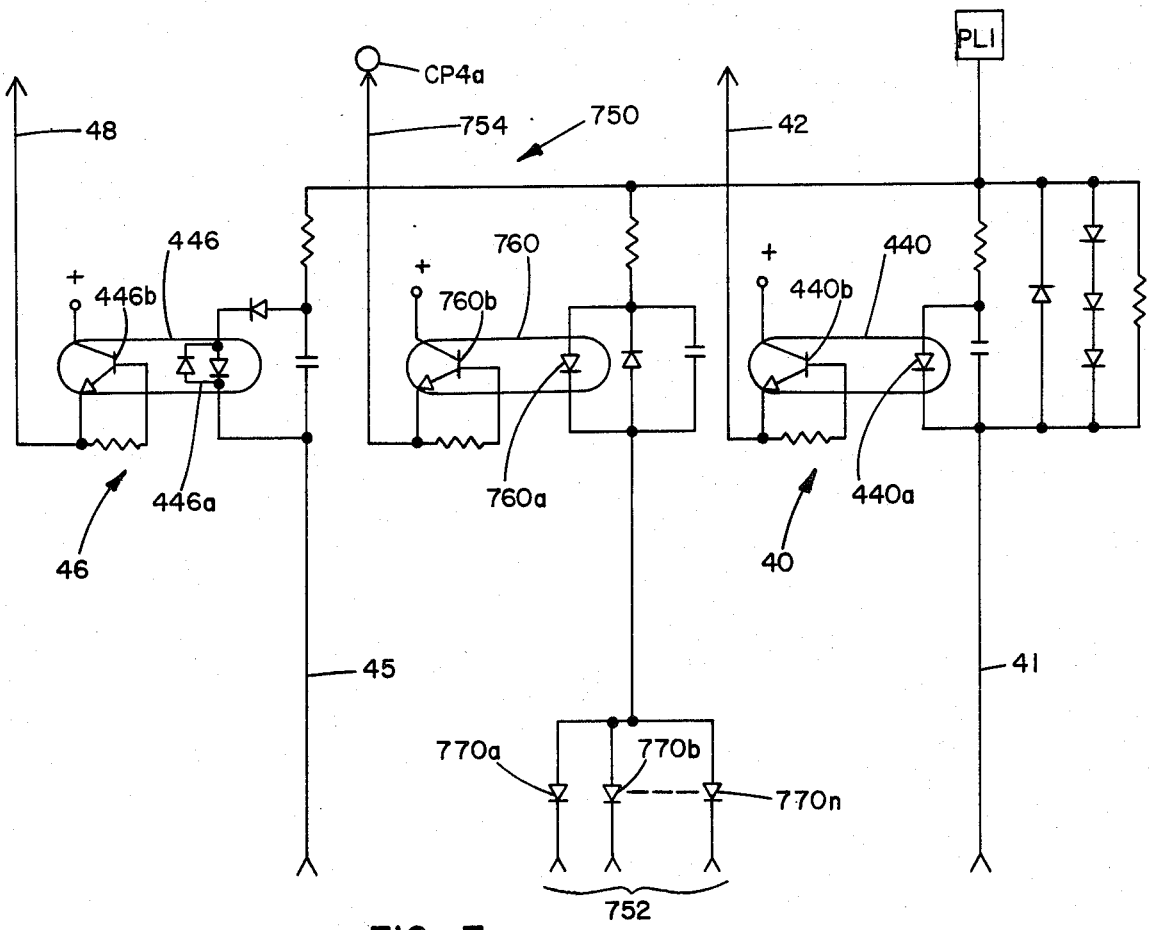
FIG. 7 depicts a particular embodiment that may be utilized as the monitor means of FIG. 6.

Referring first to FIG. 7, such figure includes optical couplers 440 and 446 which, with the circuitry associated therewith, the function and operation of which will be clear from such figure to those skilled in the art, may be employed as vend energization monitor means 40 and vend delivery monitor means 46. Light emitting diode portion 440*a* of optical coupler 440 is operatively connected between power connector PL1 and lead 41 while light emitting diode portion 446*a* of optical coupler 446 is operatively connected between power connector PL1 and lead 45. The collectors of phototransistor portions 440*b* and 446*b* of respective optical couplers 440 and 446 are connected to positive voltage sources, while the emitters thereof are connected, respectively, to leads 42 and 48. It will be readily apparent to those skilled in the art that the completion of a circuit through light emitting diode portion 440*a* of optical coupler 440 will cause transistor portion 440*b* thereof to conduct, thereby resulting in the generation of a HI signal on lead 42. Similarly, the completion of a circuit through light emitting diode portion 446*a* of optical coupler 446 will cause transistor portion 446*b* thereof to conduct, thereby resulting in production of a HI signal on lead 46.

Also depicted in FIG. 7 and shown connected to power connection PL1 in parallel circuit with optical couplers 440 and 446 is an optional optical coupler 760, the purpose and operation of which will be discussed more fully hereinafter with respect to FIGS. 11 and 12. Such optional optical coupler may be employed in the manner which will be hereinafter described to produce an external trigger signal for use in externally triggering channel scanning control means 314 to initiate channel scanning thereby.

It will be apparent to those skilled in the art that the monitor means may take any of numerous forms, including, by way of example, and not by way of limitation, those types of monitor circuits disclosed in U.S. Pat. No. 3,828,903, assigned to Applicant's assignee.

CHANNEL SCANNING CONTROL MEANS

Referring next to FIG. 8, such figure shows one possible embodiment of a channel scanning control means 314, which circuit embodiment can, depending upon which of the depicted connection point pairs CP1*a*, CP1*b* through CP4*a*, CP4*b* are connected together, be employed in either an internal or external triggering mode. Such circuit embodiment includes a first integrated circuit chip 500 which is a standard type CD4060B COS/MOS 14 stage ripple carry binary counter/divider and oscillator, and integrated circuit chip 502 which is a standard CD4022B COS/MOS counter/divider, the function and operation of which chips will be clear to those skilled in the art. Also included in such circuitry are standard D-type flip-flops 504, 506, and 508, the purpose of which will become apparent from that which follows. Other components in the circuitry and the interconnections therebetween will be more fully described in what follows and the purpose and function thereof will become clear from such description.

As has previously been indicated, the function of the channel scanning control means is to sequentially produce vend channel identification information in response to either an internal or external trigger for distribution to appropriate locations throughout the vend control circuit. Secondarily, and optionally, the channel scanning control means may be responsive to actuation of a price arming switch for effecting, in conjunction with the other vend control circuitry, the establishment of vend channel vend prices and the entry thereof into vend processor means 300 for storage.

Referring first to the standard CD4060B integrated circuit chip 500 in the circuit embodiment depicted in FIG. 8, it will be appreciated by those skilled in the art that when such chip 500 is connected to a power source with pins P9, P10, and P11 thereof connected in the RC configuration shown, the chip will function to generate ripple carry outputs on its output pins, including output pins P7, P15, P1, P2, and P3, and a timing signal ΦI will be made available on lead $\tau$ for use by vend processor means 300, as will be hereinafter shown and discussed with respect to FIG. 10, in controlling the timing of read operations by vend processor means 300. Pin P12 of integrated circuit chip 500 is a reset input R which is responsive to the occurrence of a HI signal thereupon to reset the chip such that all outputs will return to a LO level. Once the HI signal is removed from the reset input the chip thereafter operates to advance the state of the counter one step in binary order on the negative transition of ΦI (and $\Phi_0$).

Standard CD4022B integrated circuit chip 502 includes an octal counter with eight decoded outputs, only six of which (P1, P3, P7, P11, P5, and P4) are utilized in the depicted embodiment, and has clock (P14), reset (P15), and clock inhibit (P13) inputs. The appearance of a HI signal on R reset input pin P15 clears the counter to a zero count, as a consequence of which the outputs on pins P1, P3, P7, P11, P5, and P4 will all go LO. So long as the clock inhibit signal at input pin P13 is maintained HI, counter advancement via the clock line at input pin P14 will be inhibited. If tne signal present on clock inhibit pin P17 goes LO, however, the counter will thereafter advance one count for each positive clock signal transition. Tne decoded outputs, which are normally LO, go HI only at their respective decoded time slot and for one full clock cycle.

In describing the operation of the circuit of FIG. 8, it should be appreciated that the signals appearing upon leads 42, 48, and 320 are normally LO. Connection point CP1*b* (also identified as CP4*b*) is connected to tne TR trigger input 312 of channel scanning control means 314, and the application of a HI signal thereto will result in the initiation of channel scanning, which is the in turn generation of vend channel identification information identifying each available vend channel, as will be discussed in more detail in that which follows, upon data path 370, which, in this embodiment, includes the leads connected to output pins P1, P3, P7, and P11 of integrated circuit chip 502.

One method of periodically triggering channel scanning control means 314 is to apply a jumper connection between connection points CP1*a* and CP1*b* since output pin P15 of integrated circuit chip 500 is periodically pulsed HI. With such a connection channel scanning control means 314 will be internally triggered. A preferred method of external triggering, based upon selection means activation, will also be described and discussed hereinafter with respect to FIGS. 11 and 12. It should be recognized, however, that various other external stimuli, such as a coin deposit, may also be utilized with appropriate circuitry to generate external trigger signals.

Any HI signal applied to connection point CP1*b* (CP4*b*) is filtered by RC filter circuit 510 and communicated via lead 512 to C clock input 514 of D-type flip-flop 504. Since the D input 516 thereof is connected via lead 517 to a +5.6 volt voltage source, Q output 518 of flip-flop 504 will therefore go HI in response to a HI signal applied to C clock input 514, and the resulting HI signal at Q output 518 will be provided over lead 520, lead 522, and through a high-pass RC circuit 523 to R reset pin P12 of integrated circuit chip 500 to cause the outputs thereof to all be reset to a LO condition. Such HI signal at Q output 518 of D-type flip-flop 504 is also communicated over lead 520, lead 524, and through a high-pass RC circuit 525 to R reset pin P15 of integrated circuit chip 502 to cause the outputs thereof to all go LO.

In addition, such HI signal at Q output 518 of D-type flip-flop 504 is provided via lead 520 and lead 524 to both of leads 364 and 526. Lead 364 is connected, as has previously been described with regard to FIG. 6, to input 362 of NAND gate 356, the purpose and operation of which has already been described. Lead 526 is connected to input 528 of NAND gate 530, the other input 532 of which is connected to normally HI $\overline{Q}$ output 534 of D-type flip-flop 508. When the signals appearing upon inputs 528 and 532 of NAND gate 530 are both HI, the output thereof goes LO and is provided over lead 380, as has been previously described, to $\overline{R}$ read input 382 of vend processor means 300, the effect of which will be described hereinafter with regard to FIG. 10.

Following the resetting of integrated circuit chips 500 and 502, the state of the 14-stage ripple counter of chip 500 will advance one step in binary order on the negative transition of the ΦI input signal at pin P9. When the Q4 count of chip 500 goes HI, a HI output signal is produced on pin P7 of such chip 500 and is communicated to CL clock input pin P14 of integrated circuit chip 502. Since Q output 540 of D-type flip-flop 506 is normally LO, a LO signal is present at clock inhibit pin P13 of chip 502. So long as such signal at pin P13 of chip 502 remains LO, the clock input at pin P14 is not inhibited, and the occurrence of a HI signal at such clock input pin P14 will thus cause the counter of integrated circuit chip 502 to advance one count, resulting in the generation of a HI signal on pin P1 of chip 502. At such time the outputs on pins P3, P7, P11, P5, and P4 of chip 502 will remain LO, and the combination of signals appearing upon pins P1, P3, P7, and P11 will serve to identify one of four possible vend channels in a four channel vendor. Such vend channel identification information generated at output pins P1, P3, P7, and P11 of chip 502 is then provided via data path 370 to appropriate locations in the vend control circuitry, as has been previously described and as will be discussed in more detail hereinafter with respect to FIGS. 9 and 10.

In the absence of any changes in channel scanning control means input signals, integrated circuit chips 500 and 502 will continue their counting activities. With none of the connection point pairs CP2*a*, CP2*b* through CP4*a*, CP4*b* connected, integrated circuit chip 502 will continue to operate until a HI signal is produced on output pin P4 thereof and is fed back to R reset pin P15 to effect a resetting of chip 502. Upon the next occurrence of a HI clock signal at pin P14 of chip 502, which would occur upon a LO to HI transition at Q4 output pin P7 of integrated circuit chip 500, integrated circuit chip 502 would begin counting anew as chips 500 and 502 continue their cyclic counting operations.

As has previously been explained, the vend control circuit has been designed so that a HI vend energized signal will appear on lead 42 when a vend motor associated with the selection made by the customer is energized. Such HI signal is passed through an RC filter circuit 550 and is provided over a lead 552 to C clock input 554 of D-type flip-flop 506. As may be recalled from previous discussion, a HI signal is generated on lead 350, which is connected to D input 556 of D-type flip-flop 506, when a vend approval signal is produced by vend processor means 300 at vend output 336 thereof. Since the generation of a HI signal on lead 350 is a precondition for obtaining, during a vend mode of operation, the subsequent production of a HI signal on lead 42, D input 556 of flip-flop 506 will already be HI when clock input 554 of such flip-flop 506 goes HI, with the result that a HI signal is produced at Q output 540 thereof and is provided over leads 542, 544, and 546 to clock inhibit pin P13 of integrated circuit chip 502. Such HI signal is also provided over leads 542 and 544 and through RC circuit 592 (on a time delay basis, as will be explained in greater detail hereinafter) to the R reset input 594 of D-type flip-flop 508, but since such flip-flop is already in a reset condition, no change will be effected in the outputs of such flip-flop.

As has already been explained, when a HI signal is applied to clock inhibit pin P13 of integrated circuit chip 502, the clock input thereto is inhibited and chip 502 therefore ceases counting. The reason therefor is to ensure that the vend channel identification information then being provided over data path 370 will not continue to change, but will remain constant for a sufficiently long enough period to ensure that the energized vend motor will be able to effect vend delivery. Upon the completion of such vend delivery, a HI signal is produced upon lead 48 and is provided through an RC filter 560 and over lead 562 to input 564 of OR gate 566. The occurrence of a HI signal at input 564 causes output 568 to go HI, and such HI signal is provided to R reset inputs 570 and 572 of respective D-type flip-flops 504 and 506.

The application of such HI signal to the R reset inputs of flip-flops 504 and 506 will cause the respective Q outputs 518 and 540 thereof to both go LO. The LO signal produced at Q output 518 of D-type flip-flop 504 is then communicated via leads 520, 524, and 364 to input 362 of NAND gate 356, thereby resulting in the application of a HI signal at the vend disable input 358 of vend/payout select control means 346, as may be recalled from the previous discussion of FIG. 6, as a result of which vend/payout select control means will be prevented from further producing vend channel authorization signals. Such LO signal at Q output 518 of D-type flip-flop 504 is also communicated via leads 520, 524, and 526 to input 528 of NAND gate 530, thereby causing the output 531 of such gate to go HI. The change from a LO to HI signal at the output 531 of NAND gate 530 results in removal of a LO signal from the $\overline{R}$ read input 382 of vend processor means 300, thereby preventing the vend processor means 300 from being able to perform further read operations. The LO signal produced at Q output 540 of D-type flip-flop 506 is communicated over leads 542, 544, and 546 to clock inhibit pin P13 of integrated circuit chip 502 to remove the clock inhibit from such chip so that the circuit will be re-initialized and conditioned for subsequent operation whenever a HI trigger signal is next applied to lead 312 or a HI price arming signal is applied on lead 320.

As has previously been indicated, the trigger signal applied to connection point CP1*b* (CP4*b*) may be supplied either by an internal or external trigger. As has already been indicated, if an internal trigger is desired, the connection point pair CP1*a*, CP1*b* may be jumpered together in order to provide an operative connection between output pin P15 of integrated circuit chip 500 and C clock input 514 of D-type flip-flop 504. With such internal triggering set-up, it is desirable that connection point pairs CP2*a*, CP2*b* and CP3*a*, CP3*b* be connected by jumpers, as well, in order to provide operative connections from Q12 pin P1 of integrated circuit chip 500 to input 574 of OR gate 566 and from pin P5 of integrated circuit chip 502 to input 574 of OR gate 566. With such connections, the depicted embodiment of the channel scanning control means will be periodically, internally triggered to effect one complete scanning pass through the available vend channels, and, if no vend energized signal is detected during such one scanning pass, to reset itself and await generation of the next internal trigger to perform another pass. If a vend energized signal is detected during the course of such one pass, but vend completion is not subsequently detected before Q12 output pin P1 of chip 500 goes HI, such HI signal generation will cause a resetting of the channel scanning control means to permit the customer to make another selection or to obtain a refund of his credit deposit.

If external triggering of channel scanning control means is desired, various possibilities exist. One manner in which this could be accomplished is to connect the TR trigger input 312 of the circuit embodiment of FIG. 8 so that channel scanning control means 314 will be responsive to the actuation of any vend selection switch to effect channel scanning, as will be described hereinafter with respect to FIGS. 11 and 12. In such an external triggering configuration the connection point pair CP1*a*, CP1*b* would remain disconnected, while connection point pairs CP2*a*, CP2*b* and CP3*a*, CP3*b* would normally be connected in the manner previously described with respect to the internal triggering embodiment and for the same purpose.

In a service mode of operation, channel scanning control means 314 is also operable for entering vend channel vend prices into vend processor means 300. When the price arming switch 322 (FIG. 6) is actuated, a HI signal is produced on lead 320 and is provided through resistor 583 to R reset pin P12 of integrated chip 500 to effect resetting of the counter within such chip. Such HI price arming signal is also provided through a low-pass RC circuit 585 to S set input 584 of normally reset D-type flip-flop 508. The application of a HI signal to S set input 584 causes Q output 586 of flip-flop 508 of go HI and $\overline{Q}$ output 534 to go LO. The HI signal produced at Q output 586 of flip-flop 508 is communicated over lead 326 to appropriate places in the vend control circuit, as has previously been described. As has also been previously described with regard to FIG. 6, one of the results of the generation of a HI signal on lead 326 is the application of a HI signal to input 354 to NAND gate 356. Until a HI signal is also applied to input 362 of such gate, however, the output thereof will remain HI to prevent vend/payout select control means 346 from producing any vend channel authorization signals. Another result of such HI signal on lead 326 is the production of a HI signal on lead 350 to D input 556 of flip-flop 506, the purpose of which will become clear in what follows.

The LO signal resulting at $\overline{Q}$ output 534 is communicated via lead 535 to input 532 of NAND gate 530 to cause the output thereof to go HI. The resulting HI output is then communicated, as has previously been described, over lead 380 to $\overline{R}$ reset input 382 of vend processor means 300 to prevent vend processor means 300 from performing any read operations so long as the signal at input 382 remains HI.

The HI signal produced on lead 320 by actuation of price arming switch 322 is also provided through forward biased diode 590 to input 574 of OR gate 566, as a consequence of which output 568 of OR gate 566 goes HI. Such HI signal at output 568 of OR gate 566 is communicated to R reset inputs 570 and 572 of D-type flip-flops 504 and 506, respectively, to effect resetting thereof.

Resetting of flip-flop 504 causes Q output 518 thereof to go LO, as a result of which a LO signal is applied from such Q output 518 through leads 520, 524 to leads 364 and 526. The LO signal provided to lead 364 is applied therethrough to input 362 of NAND gate 356, thus causing the output thereof to be HI and thereby resulting in the appliation of a HI signal at the vend disable input 358 of vend/payout select control means 346. As has previously been explained with regard to FIG. 6, such HI signal at input 358 will inhibit vend/payout select control means 346 from generating vend channel authorization signals.

The LO signal applied to lead 526 is applied therethrough to input 528 of NAND gate 530. As will be recalled, the setting of flip-flop 508 in response to actuation of price arming switch 322 caused input 530 of NAND gate 532 to go LO. With both inputs now LO, the output of NAND gate 530 will thus be maintained HI to ensure that vend processing means 300 is prevented from performing any read operations until such time as both of inputs 528 and 532 are allowed to return HI.

Resetting of flip-flop 506 ensures that a LO signal is produced at Q output 540 thereof, which LO signal is communicated over leads 542, 544, and 546 to clock inhibit pin P13 of integrated circuit chip 502, thereby removing any clock inhibit and permitting clocked counting by the counter of chip 502. Such LO signal at output 540 is also provided over leads 542 and 390 to input 394 of price entry means 330, as has previously been described.

When the HI reset signal at R reset pin P12 of chip 500 decays after the momentary actuation of price arming switch 322, chip 500 will begin its counting action in the same manner as has been previously described with respect to the vend mode of operation, and chip 502 will generate count outputs in response to clock signals received at CL input pin P14 of chip 502. However, such action will result in no price entry activity unless a HI signal is applied to connection point CP1*b*.

Figure 11:
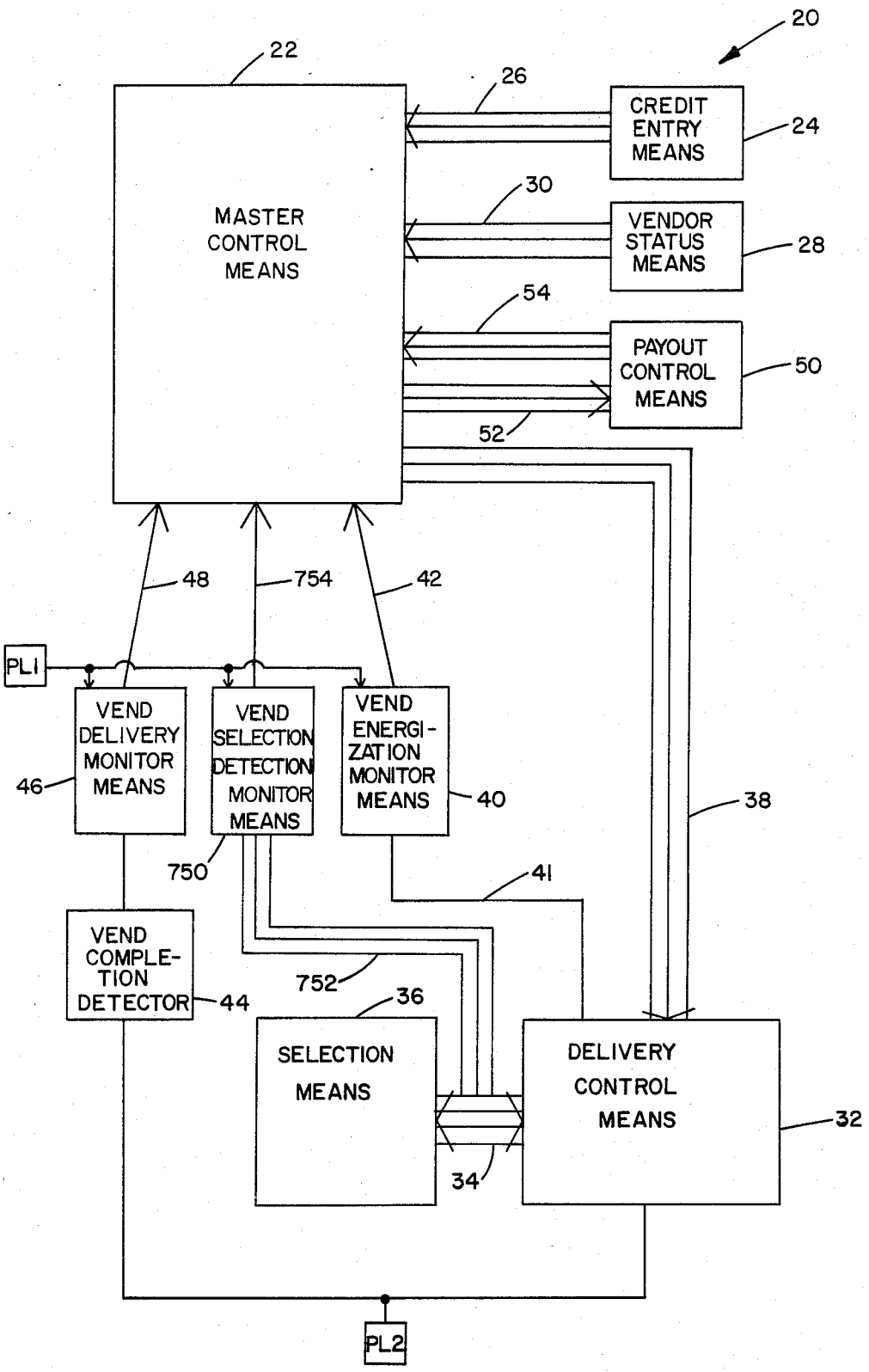
FIG. 11 shows another embodiment of the present invention similar to the embodiment of FIG. 1, but including an optional common vend selection monitor means.
Figure 12:
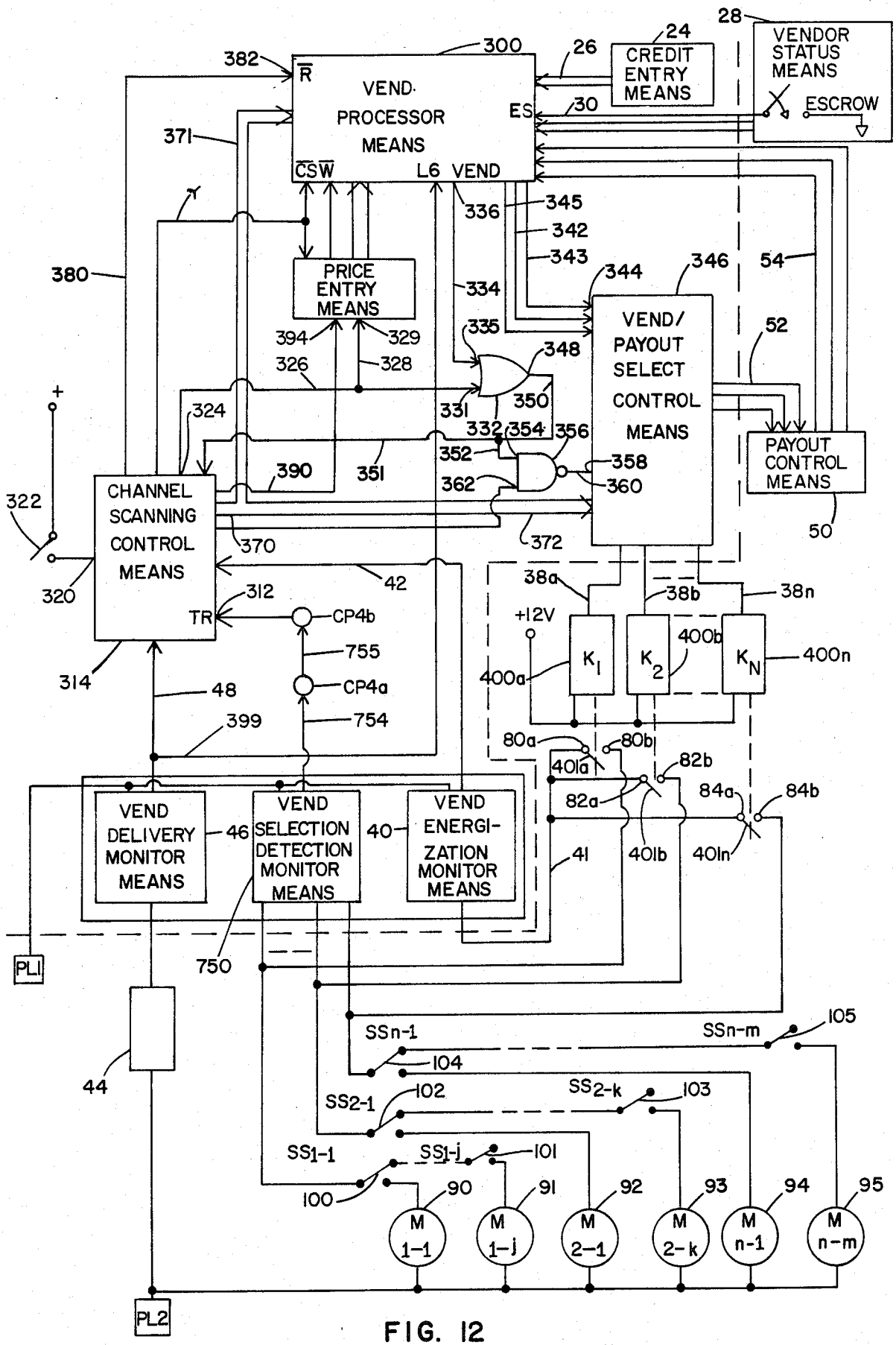
FIG. 12 depicts in greater detail a particular embodiment of the vending control circuit of FIG. 11.

As has been previously discussed and as will be further discussed with respect to FIGS. 11 and 12, connection point CP1*b* can be connected to receive either internally or externally generated trigger signals. Regardless of the source of the trigger signal, a HI trigger signal applied to connection point CP1*b* subsequent to actuation of price arming switch 322 will be filtered by RC filter circuit 510 and provided via lead 512 to C clock input 514 of D-type flip-flop 504 to cause the Q output 518 thereof to go HI, as has previously been explained. As a result thereof, HI signals will be provided to R reset pin P12 of chip 500 and to R reset pin P15 of chip 502 to again effect the resetting of such chips.

Such HI signal at Q output 518 is also provided to lead 364 and therethrough to input 362 of NAND gate 356, the other input 354 of which is already HI. With both inputs HI, the output of NAND gate 356 will go LO and such LO signal will be applied to vend disable input 358 of vend/payout select control means 346 to enable such control means to produce appropriate vend channel authorization signals depending upon the vend channel identification information being provided over data path 370.

The HI Q output signal of flip-flop 504 is also communicated to and through lead 526 to input 528 of NAND gate 530. However, since the other input 532 remains LO at such time, the output 531 thereof will remain HI to prevent vend processor means 300 from performing any read operations, as has previously been described.

Following their resetting, chips 500 and 502 will again begin their normal counting operation, with chip 502 sequentially producing output signals indentifying, in turn, each available vend channel. In response thereto, due to the LO signal present at vend disable input 358 of vend/payout select control means 346, such control means will function to generate appropriate vend channel authorization signals.

If, during such service mode operation, the serviceman has actuated a selection switch associated with the vend channel whose vend channel identification information is then being provided at the channel address output of chip 502 and over data paths 370 and 372, completion of a circuit through an appropriate vend motor will result, in the manner already previously described, as a result of which a HI vend energized signal will be produced on lead 42. Such HI vend energized signal will be fed through RC filter 550 and over lead 552 to C clock input 554 of D-type flip-flop 506. As has previously been described, the actuation of price arming switch 322 to place the vend control circuit in a service mode results in the generation of a HI signal on lead 350 to D input 556 of flip-flop 506 as a consequence of the setting of flip-flop 508. Since D input 556 of flip-flop 506 is thus HI at the time that a HI signal is applied to C clock input 554 of flip-flop 506, Q output 540 thereof will go HI and the HI signal so generated will be provided over leads 542, 544, and 546 to clock inhibit input pin P13 of integrated circuit chip 502 to inhibit further counting by such chip. The HI signal produced at Q output 540 is also provided over leads 542 and 390 to price entry means 330 to effect entry of a vend channel vend price at a location established by the vend channel identification information appearing on data path 370, as has previously been described.

Such HI signal produced at Q output 540 is additionally applied through lead 542, lead 544, and an RC circuit 592 to R reset input 594 of D-type flip-flop 508. The RC circuit includes a resistor 596 and a capacitor 598 connected to a +5.6 volt voltage source, as shown, and, due to the residual charge remaining on capacitor 598 at the time Q output 540 goes HI, application of the HI signal to reset input 594 of flip-flop 508 will be delayed for a period of time as established by the time constant of the RC circuit 592, which time period, typically, may be approximately 10 milliseconds. During such delay period HI signals will be simultaneously present at inputs 329 and 394 to the price entry means 330, as has been previously described, to effect price entry. When the delayed HI signal is then applied to R reset input 594 of D-type flip-flop 508, Q output 586 thereof will go LO and $\overline{Q}$ output 534 will return to its normal HI state. The LO at Q output 586 will be communicated over lead 326 to appropriate locations in the vend control circuit, including to input 329 of price entry means 330, to effect termination of the price entry operation by the price entry means 330, and to OR gate 332 to cause a HI signal to be applied to vend disable input 358 of vend/payout select control means 346 so as to prevent the vend/select payout control means from further producing any vend channel authorization signals, as has been previously described. Thus, the clocked setting of D-type flip-flop 506 during a service mode of operation, together with the delayed application of the HI Q output thereof to the R reset input of flip-flop 508, will result in the quick entry of a vend channel vend price into vend processor means 300 and the rapid termination of vend channel authorization signals by vend/select payout control means 346 so that the vend motor which has been energized during the course of the price entry operation will be energized too briefly to be able to operate.

At the same time as the resulting LO signal at Q output 586 of flip-flop 508 is effecting vend price entry termination and prevention of further vend channel authorization signal production, the resulting HI signal at $\overline{Q}$ output 534 is transmitted over lead 535 to input 532 of NAND gate 530 to re-initialize the output thereof such that channel scanning control means 314 will be appropriately conditioned for subsequent operations in either a service or vend mode of operation.

Since it is desirable to provide for cancellation of a price entry operation in the event that no attempt is made to enter a vend price within some established time period following actuation of the price arming switch 332 (and/or within some established time period following application of a trigger signal to connect point CP1*b*), Q14 output pin P3 of integrated circuit chip 500 is connected via lead 600 to C clock input 602 of D-type flip-flop 508. If no trigger signal has been received on lead 312 and/or if no vend energized signal has been received on lead 42 by the time that pin P3 of chip 500 goes HI, the HI signal produced at pin P3 will clock flip-flop 508 causing it to reset since D input 604 thereof is always maintained LO, as shown. Such resetting of flip-flop 508 at any point prior to receipt by channel scanning control means 314 of a HI vend energized signal on lead 42 will produce the same results as the resetting of such flip-flop by a HI signal applied at reset input 594, but, because flip-flop 504 will not have been set by the occurrence of a HI vend energized signal on lead 42, no price entry will occur.

VEND/PAYOUT SELECT CONTROL MEANS

Figure 9:
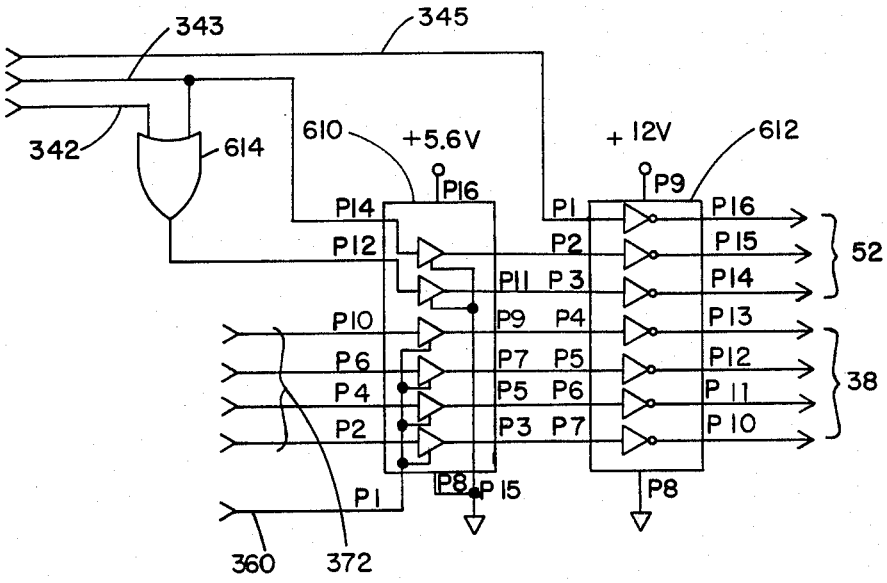
FIG. 9 depicts a particular circuit embodiment that may be utilized as the vend/payout select control means of FIG. 6.

Referring next to FIG. 9, such figure discloses a typical circuit which could be utilized as a vend/payout select control means in the present invention. The circuit embodiment of FIG. 9 includes an integrated circuit chip 610 which is a standard CD4503B COS/MOS hex buffer with two disable controls. Pin P1 is a disable control for input pins P2, P4, P6, and P10 and pin P15 is a disable control for input pins P12 and P14. In the embodiment shown, pin P15 is tied to ground, as a result of which input pins P12 and P14 will always be enabled, whereas pin P1 is connected to lead 360 and will act, when it receives a HI signal thereupon, to disable input pins P2, P4, P6, and P10. The outputs of integrated circuit chip 610 are connected to inputs of an integrated circuit chip 612 which is a standard ULN2003A chip. The functions and operations of such standard chips is well known to those skilled in the art.

When the circuit embodiment of FIG. 9 is used in conjunction with the channel scanning control means 314 depicted in FIG. 8, output pins P1, P3, P7, and P11 of integrated circuit chip 502 are operatively connected to input pins P10, P6, P4, and P2, respectively, of integrated circuit chip 610 to produce appropriate outputs at output pins P13, P12, P11, and P10, respectively, of integrated circuit chip 612 whenever the signal applied at vend disable input pin P1 of chip 610 is LO. In the event that a HI signal is present at vend disable input pin P1, the signals appearing on output pins P10–P13 of chip 612 will all be HI regardless of the input condition of the signals at input pins P2, P4, P6, and P10 of chip 610.

Input pins P12 and P14 of chip 610 and input pin P1 of chip 612 are connected to receive payback information signals from vend processor means 300. The occurrence of a HI nickel payback signal on lead 342 is provided to and through an OR gate 614 to input pin P12 of chip 610 and therethrough to input pin P3 of chip 612 to produce a LO output on pin P14 of chip 612, which LO signal is provided over data path 52 to payout control means 50 for use in operating a payback motor during payback operations. A HI dime payback signal on lead 343 is provided both to and through the same OR gate 614 to effect a LO signal on output pin P14 of chip 612, and also to input pin P14 of chip 610 to produce a LO signal on output pin P15 of chip 612, which LO signals are provided to payout control means 50 to operate both a payback motor and a dime solenoid during payback operations. A HI quarter payback signal is provided to input P1 of chip 612 whenever a quarter payback signal is generated by vend processor means 300, and the application of such a HI signal to input pin P1 of chip 612 results in a LO signal on output pin P16 of chip 612, which signal is provided via data path 52 to payout control means 50 to operate a quarter payback motor during payback operation.

VEND PROCESSOR MEANS

Figure 10:
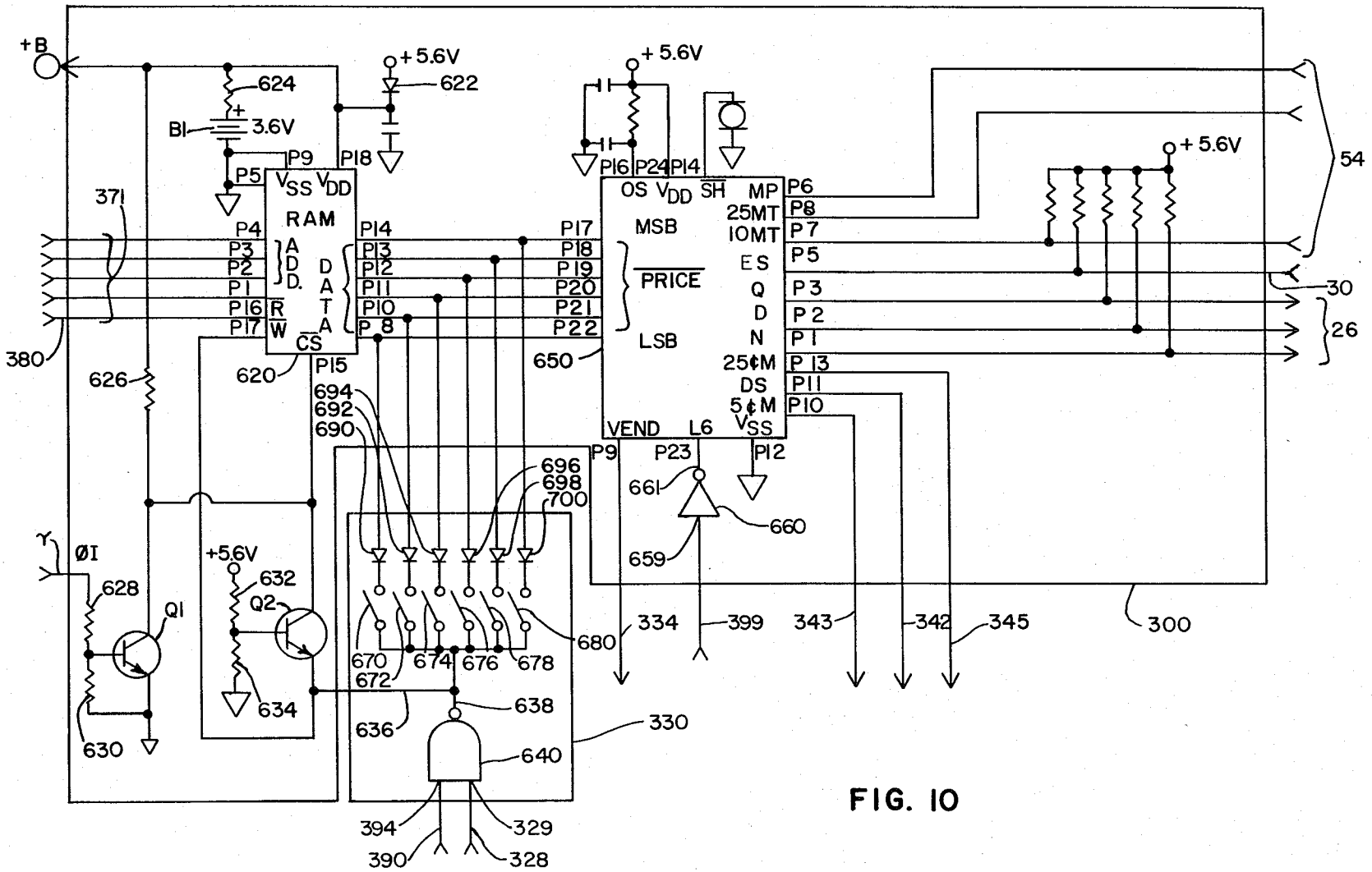
FIG. 10 depicts a particular circuit embodiment that may be utilized as the vend processor means of FIG. 6.

Referring next to FIG. 10, such figure discloses a particular circuit embodiment that may be utilized as vend processor means 300 and price entry means 330 in the subject invention. The vend processor means 300 includes an integrated circuit chip 620 which is a standard CDP 1824 32-word×8-bit static random-access memory, the function and operation of which will be readily apparent to and understood by those skilled in the art. In the configuration shown, addressing information is provided to such chip on pins P1–P4. Pins P8 and P10–P14 may function as either input or output pins depending upon the status of $\overline{R}$ read input pin P16 and $\overline{W}$ write input pin P17. The application of a HI signal at $\overline{CS}$ chip select pin P15 de-selects such chip and disables output therefrom. Under such circumstances, chip 620 will not react to either a read or write signal. When $\overline{CS}$ chip select pin P15 is LO such chip is selected and the operation thereof is determined by the status of signals appearing on input pins P16 and P17. If HI signals are present on both of pins P16 and P17, such chip will be in a stand-by mode and its output will be disabled. When $\overline{R}$ read input pin P16 is HI and $\overline{W}$ write input pin P17 goes LO, the chip will function to store (write) the data present on pins P8 and P10–P14 at a storage location identified by the combination of signals appearing on address input pins P1–P4. When the converse situation exists, that is, when $\overline{W}$ write input pin P17 is HI and $\overline{R}$ read output pin P16 goes LO, the chip will function to read out onto pins P8 and P10–P14 that data stored at the storage location identified by the combination of signals appearing on address input pins P1–P4. It may be observed at this point that pin P18 of chip 620 is connected through a forward biased diode 622 to a +5.6 volt source, which source is also utilized to trickle charge battery B1, the importance of which will become apparent hereinafter, through diode 622 and resistor 624.

Such circuit also includes a pair of transistors Q1 and Q2 whose collectors are connected in common to $\overline{CS}$ chip select pin P15 of chip 620 and to and through resistor 626 and diode 622 to the +5.6 volt source. Transistor Q1 is a grounded emitter transistor whose base is connected through a voltage divider network including resistors 628 and 630 to lead $\tau$ which carries the ΦI timing signal produced in the channel scanning control means embodiment depicted in FIG. 8, as has previously been discussed. The base of transistor Q2 is connected through a voltage divider network incuding resistors 632 and 634 to a +5.6 volt source and its emitter is connected in common to a write input pin P17 of chip 620 and via lead 636 to the output 638 of NAND gate 640, whose inputs 394 and 329 are connected, respectively, to leads 390 and 328.

In the event of power loss or failure, both of transistors Q1 and Q2 will be OFF. In such a power loss situation, battery B1 will supply sufficient voltage through resistors 624 and 626 to $\overline{CS}$ chip select input pin P15 of chip 620 to cause the chip to enter a de-select mode and will also provide sufficient voltage through resistor 624 to $V_{DD}$ input at pin P18 to prevent chip 620 from losing data stored therein. Because transistors Q1 and Q2 have a very low leakage current in reverse bias, they are employed to minimize battery drainage during power interruptions.

Under normal conditions and in a vend mode of operation, output 638 of NAND gate 640 will normally be HI, as a result of which $\overline{W}$ write input pin P17 of chip 620 and the collector of transistor Q2 will be maintained HI. Under such circumstances, when ΦI on lead $\tau$ is LO, transistor Q1 will be turned OFF and a HI signal will be applied to $\overline{CS}$ chip select input pin P15 of chip 620 from the +5.6 volt source through diode 622 and resistor 626 in order to maintain the chip in a de-select mode. Whenever the ΦI signal on lead $\tau$ goes HI, transistor Q1 will turn ON, as a consequence of which the collector of transistor Q1 will be pulled LO thereby applying a LO signal to $\overline{CS}$ chip select input pin P15 of chip 620 to select such chip and to thereby permit such chip to respond to read or write inputs, as appropriate.

Vend processor means 300 further includes an integrated circuit chip 650, the function and operation of which is generally similar to the circuitry disclosed in U.S. Pat. No. 3,841,456, assigned to Applicant's assignee, and especially to the circuitry therein that includes the circuit chip 10, the escrow control 26, vend control 30, and interconnecting circuitry. The same or functionally similar circuits or chips are discussed and employed in vend control circuits described in U.S. Pat. Nos. 3,894,220; 4,034,839; 4,008,792; 4,359,147; and U.S. patent application Ser. No. 283,656, all assigned to Applicant's assignee. Such integrated circuit chip 650 includes standard $V_{DD}$ and grounding connections as well as an OS oscillator control input pin P16 and a $\overline{SH}$ shock reset input pin P14, the purposes of which will be readily understood by those skilled in the art. Such chip further includes a set of input pins P1–P3 connected via data path 26 to credit entry means 24 to receive credit entry inputs, and such chip is responsive to such inputs to accumulate total credit entered by a customer. The chip also includes $\overline{price}$ input pins P17–P22 which are connected to pins P8 and P10–P14 of chips 620, as shown, to receive vend price information when such information is read out of chip 620, and an ES escrow input pin P5 which is connected through a data path 30 to vendor status means 28 to receive escrow requests.

In the event that a customer has made a deposit, the total of which has been accumulated by chip 650, and such customer thereafter actuates an escrow switch associated with the vendor status means 28 at a time when chip 620 has been de-selected and no vend channel vend price information is being provided to price input pins P17–P22 of chip 650, chip 650 will enter into a payback mode of operation, as a consequence of which vend operations by such chip will be inhibited pending completion of the payback operation. During payback operation, appropriate signals will be produced on output pins P10, P11, and P13 of chip 650, which signals will be provided over respective leads 343, 342, and 345 to a vend/payout select control means, such as has been previously described in FIG. 9, for controlling payout control means 50. Signals are supplied back from the payout control means 50 over data path 54 to provide information regarding such payback operations to integrated circuit chip 650. Typically such feedback signals may include dime empty, quarter empty, and motor pulse signals which, in the depicted embodiment, are provided to pins P7, P8, and P6, respectively, for use by chip 650 in the further control of payback operations. At the conclusion of a payback operation, chip 650 is re-initialized and conditioned to be able to control subsequent vend and payback operations, as may be appropriate or necessary.

If the customer does not make an escrow request, and, as a result, the vend contol system functions in a normal vend mode of operation, vend channel vend price information is supplied to input pins P17–P22 of chip 650 and such chip operates to compare the total credit entered against the vend channel vend price information being supplied to the price input pins, and to produce vend approval signals, when appropriate, as has already been described, at output 334 of vend processor means 300. When performing such functions chip 650 acts to inhibit recognition of an escrow request by a customer who may have already made a vend selection so that he will be unable to obtain both a successful vend and also escrow of his deposit. In the particular embodiment depicted in FIG. 10, the price information that is supplied as a binary representation of a vend channel vend price at inputs P17–P22 of chip 650 is supplied in 2's complement form. If the total credit accumulated by chip 650 is greater than or equal to the vend channel vend price whose representation is being supplied to chip 650, a HI vend approval signal will be produced at vend output pin P9 of chip 650, which signal will be provided over lead 334, as has been previously described, to enable vend/payout control means 346 to produce an appropriate vend channel authorization signal for the vend channel whose vend channel vend price has successfully undergone comparison by chip 650. It should be appreciated that when a vend approval signal is produced at vend output pin P9 of chip 650, it has not yet been determined whether a product associated with the vend channel whose vend price has just undergone comparison will actually be vended or even whether a vend selection switch associated with such channel has been actuated. In effect, the vend control circuit is operating on a look-ahead basis in approving a vend for the channel whose vend price has just undergone comparison, without, at that stage, any knowledge of, or regard for, which, if any vend selection has been selected. Due to the design of the remainder of the circuitry in the vend control system, if no selection is made of a product associated with such vend channel, no vending of a product in that channel will occur, as has already previously been discussed. On the other hand, if it is determined in subsequent circuitry that a vend selection belonging to such vend channel has been made, vending of the appropriate selection will be effected.

If the vend channel vend price whose representation is being supplied to the price input pins of chip 650 is greater than the total credit accumulated by such chip, no vend approval signal will be produced at vend output pin P9 of chip 650 and such chip will be reconditioned for subsequent operation. Due to the operation of channel scanning control means 314, addressing information supplied to chip 620 will change as the channel scanning control means sequences through the available vend channels, and as this occurs the vend channel vend price representation being supplied to price input pins P17–P22 of chip 650 at a particular time will reflect the vend channel vend price for the vend channel whose identification is then being supplied to address inputs P1–P4 of chip 620. For each comparison operation performed by it, chip 650 will either generate or forego the generation of a vend approval signal at vend output pin P9, as appropriate.

If, for a given vend approval signal produced at vend output pin P9 of chip 650, a vend channel authorization signal is produced on data path 38 and a circuit is completed through a vend motor associated with the vend selection switch actuated by the customer, a vend energized signal will be supplied over lead 42 to channel scanning control means 314, as previously described, to terminate further scanning operation by the channel scanning control means, as a result of which the vend channel authorization signal then being produced will be maintained for a sufficiently long enough period to permit the energized vend motor to operate. Thereafter, when vend delivery is detected and a HI vend completion signal is produced on lead 48, such HI signal will be communicated over lead 399 to the input 659 of an inverter 660, the output 661 of which is connected to L6 input pin P23 of integrated circuit chip 650 and will go LO in response to the application of a HI to input 659. The presence of a LO signal on L6 input pin P23 of chip 650 alerts such chip to the successful completion of a vend operation, and, as a result thereof, chip 650 effects collection by the vending system of the appropriate vend channel vend price for the vend effected and, if payback is required, enters a payback mode of operation and thereafter functions in a manner as previously described to effect payback of any excess deposit amounts.

It will be recalled from explanations presented hereinabove regarding the channel scanning control means that, whenever either a vend completion signal is received by the channel scanning control means 314 or the maximum period of time established for vend completion has passed, channel scanning control means 314 will be re-initialized. As a consequence of such re-initialization of channel scanning control means 346, the signal provided by such control means 346 to $\overline{R}$ read input pin P16 of chip 620 will go HI, thereby causing the data signals present on output pins P8 and P10–P14 of chip 620 to all go HI. Such resulting HI data signals from chip 620 are provided to price input pins P17–P22 of chip 650, and, since the combination of input signals present at such pins is a 2's complement binary representation of the vend price being supplied, chip 650 will view such input as a zero vend price (or lack of a vend price) and will cease further comparison operations until it subsequently again receives a non-zero vend price.

PRICE ENTRY MEANS

Vend processor means 300 of the FIG. 10 embodiment is also employed in conjunction with channel scanning control means 314 and price entry means 330, such as the price entry means depicted in FIG. 10, when the vend control system is in a service mode of operation for establishing vend prices for the various vend channels. The price entry means 330 depicted in FIG. 10 includes a set of normally open price switches 670–680 all connected in common to the output 638 of NAND gate 640, previously discussed. The normally open contacts of such switches are connected to the cathodes of respective diodes 690–700, the anodes of which are connected, respectively, to pins P8 and P10–P14 of integrated circuit chip 620.

As has previously been discussed, when a price entry operation is initiated, HI signals will be produced on leads 380 and 328 and communicated, respectively, to $\overline{R}$ read input pin P16 of chip 620 and to input 329 of NAND gate 640. Since the signal provided on lead 390 to input 394 of NAND gate 640 is normally LO, output 638 of such gate 640 will initally be in its normal HI state, and such HI signal will be provided via lead 636 to the emitter of transistor Q2, as a result of which the signal appearing at $\overline{W}$ write input pin P17 of 620 will initially be HI. As the price entry operation is effected, signal representations identifying and corresponding to the various vend channels available will be produced by channel scanning control means 346 and supplied to address input pins P1–P4 of chip 620. However, so long as HI signals remain at both $\overline{R}$ read and $\overline{W}$ write input pins P16 and P17 of chip 620, chip 620 will not operate to either read or write, and the information present at input pins P1–P4 of chip 620 will therefore be of no effect with respect thereto.

Thereafter, when a vend energized signal is provided over lead 42 to channel scanning control means 314 in response to the completion of a circuit through a vend motor associated with a vend selection switch actuated by the serviceman during the course of the price entry operation, channel scanning control means 314 will operate, as has previously been described, to effect generation of a HI signal on lead 390, which HI signal is provided to input 394 of NAND gate 640. Since input 329 of such NAND gate will already be HI, generation of a HI signal on lead 390 will result in the simultaneous occurrence of HI signals at both of inputs 329 and 394 of NAND gate 640, as a consequence of which the output 638 thereof will go LO thereby causing a LO signal to be communicated through each price switch 670–680 which has been closed and to pull down through respective diodes 690–700 respective data pins P8 and P10–P14 of chip 620.

The LO signal at output 638 of NAND gate 640 is also communicated over lead 636 to the emitter of transistor Q2, thereby resulting in the application of a LO signal to $\overline{W}$ write input pin P17 of chip 620 and ensuring that a LO signal is provided at the same time to $\overline{CS}$ chip select input pin P15 of chip 620. As a result thereof, chip 620 will operate to read in and store a vend price signal (or, more accurately, the 2's complement binary representation of a vend price signal) at a storage location corresponding to the vend channel identification information then being produced by channel scanning control means 314 and communicated to address inputs P1–P4 of chip 620. As has previously been described, the signals at inputs 394 and 329 of price entry means 330 remain HI simultaneously for only a brief period of time before the signal at input 329 is caused to return LO, thus resulting in the return of output 638 of NAND gate 640 to a HI condition and thereby terminating the price entry operation.

COMMON VEND SELECTION MONITOR MEANS

Referring now briefly to FIGS. 11 and 12, FIG. 11 depicts a vend control system embodiment similar to FIG. 1, but including a common vend selection monitor 750 connected by a data path 752 to detect the actuation by a customer of any selection switch of selection means 36. Detection of a vend selection by the common vend selection monitor means 750 results in the generation by monitor means 750 of a HI vend selection detect signal on lead 754, which lead may be connected to master control means 22 to effect initiation of operation thereby whenever any vend selection is made by a customer. FIG. 12 depicts in greater detail the manner in which a vend selection detection monitor means 750 may be employed in a circuit embodiment such as that depicted in FIG. 6 and already described in detail. In FIG. 12 a jumper 755 is shown connecting connection point pair CP4*a* and CP4*b* together so that lead 754 will be operatively connected to TR trigger input 312 of channel scanning means 314, which control means may be constructed in accordance with the channel scanning control means circuit embodiment depicted in FIG. 8.

One possible embodiment of a vend selection monitor means that may be employed is depicted in FIG. 7 and is specifically designed for use with the delivery control means 32 and selection means 34 of FIG. 3, wherein data path connections 752 are shown in dotted outline. In the embodiment of FIG. 7, the vend selection information presented over data path 752 is provided to a set of diodes 770*a*–770*n* which are connected in common to the LED portion 760*a* of an optical coupler 760. Whenever any vend selection switch is actuated by a customer, the circuit completion therethrough results in the application of a LO signal on an appropriate lead in data path 752, which LO signal causes an appropriate diode from the diode set 770*a*-770*n*to begin conducting, thereby completing a circuit through the LED portion 760*a* of optical coupler 760. Phototransistor portion 760*b* of optical coupler 760 is responsive to such circuit completion through LED portion 760*a* and begins conducting, thereby effecting a HI signal on lead 754, which lead is shown connected to connection point CP4*a*. When such connection point is connected to connection point CP4*b* (FIGS. 8 and 12) the HI signal will then be communicated to TR trigger lead 312 of the channel scanning control means 314 to initiate channel scanning operation by the channel scanning control means 314.

If the channel scanning control means circuit embodiment of FIG. 8 is employed with the vend selection detection optical coupler 760 of FIG. 7, it is preferable that connection point pairs CP2*a*, CP2*b* and CP3*a*, CP3*b* of FIG. 8 be connected, as previously described, so that, in the event that certain vend operations do not occur within a preestablished time period, the circuit can be reset in the manner and for the reasons already discussed. It will be appreciated that a common vend selection monitor means could also be employed with many other delivery control means and selection means than those depicted in FIG. 3, and FIGS. 4–5 include in dotted outline leads for a data path 752, which leads may, in one possible configuration, be connected to diodes in the diode set 770*a*-770*n*of FIG. 7 so that selection by a customer of a vend selection by operation of the selection means depicted in FIGS. 4–5 will effect a circuit completion through photodiode portion 760*a* of optical coupler and thereby effect the application of a HI trigger signal to TR trigger input 312 of channel scanning control means 314. As with vend energization monitor means 40 and vend delivery monitor means 46, it should be recognized that numerous other monitor means than that disclosed in FIG. 7 could be equally as well employed to achieve the desired result.

It will be apparent from the foregoing that the subject invention described herein may be used with vending machines that include a variety of different selection means and delivery control means, and may include various circuit embodiments. Although the invention has been described primarily in terms of a four channel vending machine, it should be recognized that the embodiments discussed may be easily modified for machines including more channels. In this regard, it will be apparent to those skilled in the art that although several of the embodiments that have been discussed employ data busses wherein only one of four lines may be active at a given time, it is possible, and in many instances may be desirable, to employ data busses on which are generated binary coded decimal signals for identifying particular vend channels and addresses associated therewith. This is particularly true with regard to the delivery control means and selection means of FIGS. 4 and 5 wherein each of tne vend motors A–Z may represent a different vend channel having a distinct vend channel price.

Thus, there has been shown and described a novel look-ahead vend control employing a common vend energization monitor means to effect vend selection recognition for vending, which means reduces that amount and replication of circuitry required by vend control circuits for use with multi-channel vendors and eliminates the need for separate selection monitor circuits for each of the different channels of a multi-channel vendor. It will be apparent to those skilled in the art, however, that many changes, modifications, variations, and other uses and applications of the subject means are possible, and all such changes, modifications, variations, and other uses and applications which do not depart from the spirit and scope of the invention are deemed to be covered by the invention which is limited only by the claims which follow.

What is claimed is:

1. A vend control circuit for use in a vending system for vending a plurality of vend selections at least some of which may be differently priced from one another, each differently priced vend selection defining a distinct vend channel, each vend channel having a pre-established vend price and at least one vend selection associated therewith, the vending system having delivery control means including a plurality of vend delivery means, each vend selection having a vend delivery means associated therewith, means for supplying power to the vend delivery means, and selection means for selecting from among the plurality of possible vends, the selection means being operatively connected to the delivery control means and actuatable to enable communication to the delivery control means of selection information identifying the vend selection selected, the delivery control means effecting energization of the vend delivery means associated with a vend selection selected when, during the time that selection information identifying the particular vend selection selected is communicated to the delivery control means, a vend is authorized for the vend channel that has associated therewith the particular vend selection selected, the vend control circuit comprising credit entry means for receiving credit entries and for generating credit information signals, master control means operatively connected to the credit entry means to receive tne credit information signals therefrom and to accumulate total credit entered, said master control means operable to sequentially compare total credit entered against the vend price associated with each respective vend channel and to produce a respective vend channel authorization signal if the total credit entered at least equals the vend price associated with such vend channel, means for communicating vend channel authorization signals to the delivery control means, vend energization monitor means for detecting the energization of any vend delivery means and for producing a vend energized output signal in response thereto, and means for communicating the vend energized output signal to the master control means, the master control means being responsive to the vend energized output signal to inhibit further comparison by the master control means of total credit entered against the vend price associated with each respective vend channel and to maintain the production of the vend channel authorization signal then being produced for a sufficiently long enough period to permit the vend delivery means that has been energized to operate.

2. The vend control circuit of claim 1 wherein said master control means includes channel scanning control means for sequentially generating vend channel identification signals identifying respective vend channels, vend processor means for comparing the total credit accumulated against the vend price for the vend channel whose vend channel identification signal is then being generated by said channel scanning control means and for producing a vend approval signal if the total credit accumulated exceeds such vend channel vend price, and select control means including a vend select control connected to receive the vend channel identification signal being generated by said channel scanning control means and to receive and be responsive to said vend approval signal to produce a vend channel authorization signal for the particular vend channel whose vend channel identification signal is then being generated by said channel scanning control means.

3. The control circuit of claim 2 wherein said channel scanning control means includes clock means for periodically initiating the sequential generation of vend channel identification signals by such channel scanning control means.

4. The vend control circuit of claim 2 wherein said channel scanning control means includes a trigger input and said channel scanning control means is responsive to a trigger signal applied to said trigger input to initiate the sequential generation of vend channel identification signals by said channel scanning control means.

5. The vend control circuit of claim 4 including customer actuatable means for producing a trigger signal.

6. The vend control circuit of claim 4 including a vend selection monitor means connected to detect any actuation of the selection means by a customer and to be responsive thereto to produce a trigger signal.

7. The vend control circuit of claim 6 wherein said vend selection monitor means includes a first portion and a second portion under control of said first portion, said first portion connected in circuit with the selection means and having energized and de-energized states, operation of the selection means effecting a change in state of said first portion of said vend selection monitor means, said second portion responsive to such change in state of said first portion to produce said trigger signal.

8. The vend control circuit of claim 2 wherein said channel scanning control means is connected to receive said vend energized output signal and is responsive thereto to prevent further sequential production of vend channel identification signals and to maintain the vend channel identification signal then being produced for a sufficiently long enough period to permit the vend delivery means that has been energized to operate.

9. The vend control circuit of claim 8 including vend completion means for producing a vend completion signal at the conclusion of a vend delivery operation, said channel scanning control means and said vend processor means both connected to receive said vend completion signal and responsive thereto to effect re-initialization of the vend system for subsequent operations.

10. The vend control circuit of claim 9 wherein the vending system includes payout means, said vend processor means operatively connected to the payout means and responsive to said vend completion signal to control payback by the payout means of excess deposits.

11. The vend control circuit of claim 8 wherein said master control means includes price arming means and price entry means, said price arming means connected to said channel scanning means and operable by service personnel to initiate a price entry operation, said channel scanning control means responsive to operation of said price arming means to enter a service mode of operation, to generate a price arming signal, and to thereafter be operable to initiate the sequential generation of vend channel identification signals and to produce a vend select control enable signal, said vend select control connected to receive said price arming signal and said vend select control enable signal and responsive to the simultaneous occurrence thereof to thereafter produce a vend channel authorization signal for each particular vend channel whose vend channel identification signal is generated by said channel scanning control means, said channel scanning control means responsive when in such service mode of operation to a vend energized signal to cause said channel scanning control means to cease further sequential generation of vend channel identification signals, to maintain the vend channel identification signal then being produced, and to generate a price entry signal, said price entry means including means for establishing price data and means for supplying said price data to said vend processor means, said price entry means connected to receive said price arming signal and said price entry signal and responsive to the simultaneous occurrence thereof to produce a write signal, said vend processor means including data storage means with storage locations associated with respective vend channels for storing vend price information for such respective vend channels, said vend processor means connected to receive said write signal and responsive thereto to store in said data storage means at a storage location associated with the vend channel whose vend channel identification signal is then being generated by said channel scanning control means vend price information corresponding to the price data being supplied to said vend processor means, said channel scanning control means being further responsive to said vend energized signal to effect re-initialization of the vending system for subsequent operation.

12. The vend control circuit of claim 11 wherein said channel scanning control means includes means responsive to a vend energized signal while said channel scanning control means is in a service mode to cause said vend select control enable signal to rapidly be terminated, including time delay means for delaying such termination sufficiently long enough to permit storage of vend price information into said vend processor means, such rapid termination of the vend select control signal after vend price information storage effecting rapid termination of the vend channel authorization signal that was being generated by said vend select control and thereby preventing full operation of the vend delivery means that had been energized.

13. The vend control circuit of claim 11 wherein said channel scanning control means includes clock means for periodically initiating the sequential generation of vend channel identification signals by such channel scanning control means.

14. The vend control circuit of claim 11 wherein said channel scanning control means includes a trigger input and said channel scanning control means is responsive to a trigger signal applied to said trigger input to initiate the sequential generation of vend channel identification signals by said channel scanning control means.

15. The vend control circuit of claim 11 including a vend selection monitor means connected to detect any actuation of the selection means by a customer and to be responsive thereto to produce a trigger signal.

16. The vend control circuit of claim 1 including vend completion means for producing a vend completion signal at the conclusion of a vend delivery operation, said master control means connected to receive said vend completion signal and to be responsive thereto to effect re-initialization of the vending system for subsequent operations.

17. The vend control circuit of claim 16 wherein said vend completion means includes vend completion monitor means and vend detector means, said vend completion monitor means including a first portion and a second portion under control of said first portion, said first portion connected in circuit with said vend selection means and having energized and de-energized states, actuation of said vend detector means effecting a change in state of said first portion of said vend completion monitor means, said second portion responsive to such change in state of said first portion to produce said vend completion signal.

18. The vend control circuit of claim 17 wherein said vend detector means includes switch means actuated by delivery of a vend selection.

19. The vend control circuit of claim 1 wherein said master control means includes means for establishing vend channel vend prices.

20. The vend control circuit of claim 19 wherein said master control means includes vend processor means and data storage means with storage locations associated with respective vend channels for storing vend price information for such respective vend channels, and wherein said means for establishing vend channel vend prices includes price arming means and price data entry means, said price arming means connected to said vend processor means and operable by service personnel, said price data entry means including means for producing price data and for supplying such price data to said data storage means, said master control means responsive to operation of said price arming means to enter a service mode of operation and operable thereafter to sequentially produce vend channel authorization signals for respective vend channels, said master control means responsive when in such service mode of operation to receipt of a vend energized signal to prevent any further sequential production of vend channel authorization signals, to store in said data storage means at a storage location associated with the vend channel whose vend channel authorization signal is then being produced vend price information corresponding to the price data then being supplied from said price data entry means, and to subsequently effect re-initialization of the vending system for subsequent operations.

21. The vend control circuit of claim 20 wherein said master control means includes a trigger input and said master control means is responsive to a trigger signal applied to said trigger input to initiate the sequential production of vend channel authorization signals by said master control means.

22. The control circuit of claim 21 wherein said master control means includes clock means for periodically generating a trigger signal and means for supplying said trigger signal to said trigger input.

23. The vend control circuit of claim 21 including a vend selection monitor means connected to detect any actuation of the selection means by a customer and to be responsive thereto to produce a trigger signal.

24. The vend control circuit of claim 20 wherein said master control means includes means responsive to a vend energized signal while said master control means is in a service mode for rapidly terminating the vend channel authorization signal then being produced, including time delay means for delaying such termination sufficiently long enough to permit storage of vend price information into said data storage means, such rapid termination of the vend channel authorization signal occurring quickly enough to prevent full operation of the vend delivery means that had been energized.

25. The vend control circuit of claim 20 wherein said price data entry means includes a plurality of switches operable by service personnel to establish a binary coded price data word.

26. The vend control circuit of claim 1 wherein said vend energization monitor means includes a first portion connected in circuit with the means for supplying power to the vend delivery means and with the plurality of vend delivery means, said first portion having energized and de-energized states, and a second portion under control of the first portion and responsive to a change in state of said first portion to produce said vend energized output signal, energization of the particular vend delivery means associated with the vend selection selected effecting a change in state of said first portion of said vend energization monitor means and thereby effecting production of a vend energized output signal.

27. The vend control circuit of claim 26 wherein said first portion of said vend energization monitor means is connected is series circuit with the means for supplying power to the vend delivery means and in common to the plurality of vend delivery means such that energization of any vend delivery means will effect energization of said first portion of said vend energization monitor means.

28. The vend control circuit of claim 1 wherein said master control means includes a microprocessor programmed to control operation of said master control means.

29. The vend control circuit of claim 28 wherein said microprocessor is programmed when in its vending mode of operation to (a) compare total credit accumulated against the vend price for a first vend channel, and, if total credit accumulated at least equals such vend price, proceed to step (c), or, if total credit accumulated is less than such vend price, proceed to step (b), (b) compare total credit accumulated against the vend price for the next vend channel in sequence, and, if total credit accumulated at least equals such vend price, proceed to step (c), or, if total credit accumulated is less than such vend price, proceed to step (b), (c) generate a vend channel authorization signal for tne vend channel whose vend price has just undergone comparison, (d) check to determine if a vend energized signal has been received by said master control means and, if so, proceed to step (f), or, if not, proceed to step (e), (e) terminate production of the vend channel authorization signal then being produced and proceed to step (b), (f) prevent further sequential comparisons and maintain the vend channel authorization signal then being produced for a sufficiently long enough period to enable the vend delivery means that has been energized to operate, (g) effect re-initialization of the vend control system for subsequent operations.

30. The vend control circuit of claim 29 including payback means and wherein the microprocessor is programmed to include in step (g) the step of controlling payback of excess deposits.

31. The vend control circuit of claim 29 wherein said microprocessor is further programmed to proceed to step (g) if the program has not progressed from step (a) to step (f) within a pre-established reset time interval.

32. The vend control circuit of claim 29 including vend completion means for producing a vend completion signal at the conclusion of a vend delivery operation, said microprocessor connected to receive said vend completion signal, wherein programmed step (g) includes the steps of (j) checking to determine if a vend completion signal has been received by said master control means and, if so, proceeding to step (k), or, if not, proceeding to step (j), (k) re-initializing the vending control system for subsequent operations.

33. The vend control circuit of claim 32 wherein said microprocessor is further programmed to proceed to step (k) if a vend completion signal is not received by said master control means within a pre-established time interval after initiation of step (f).

34. The vend control circuit of claim 29 wherein said microprocessor is programmed to periodically initiate program step (a).

35. The vend control circuit of claim 29 wherein said microprocessor is programmed to be responsive to an external trigger signal to initiate program step (a).

36. The vend control circuit of claim 35 including customer actuatable means for producing a trigger signal.

37. The vend control circuit of claim 29 including a vend selection monitor means connected to detect any actuation of the selection means by a customer and to be responsive thereto to produce a trigger signal.

38. The vend control circuit of claim 37 wherein said vend selection monitor means includes a first portion and a second portion under control of said first portion, said first portion connected in circuit with the selection means and having energized and de-energized states, operation of the selection means effecting a change in state of said first portion of said vend selection monitor means, said second portion responsive to such change in state of said first portion to produce said trigger signal.

39. The vend control circuit of claim 28 wherein said master control means includes price arming means, price data entry means, and data storage means, said price arming means being operable by service personnel to generate a price arming signal, said price data entry means including means for establishing price data, said data storage means including storage locations associated with respective vend channels for storing vend price information for such respective vend channels, said microprocessor operatively connected to receive said price arming signal, said data storage means connected to receive said price data, said microprocessor programmed to be responsive to said price arming signal to enter a price entry mode operation and to thereafter (p) generate a vend channel authorization signal for a first vend channel, (q) check to determine if a vend energized signal has been received by said master control means and, if so, proceed to step (t), or, if not, proceed to step (r), (r) generate a vend channel authorization signal for the next vend channel in sequence, (s) check to determine if a vend energized signal has been received by said master control means and, if so, proceed to step (t), or, if not, proceed to step (r), (t) store in said data storage means at a storage location associated with the vend channel whose vend channel authorization signal was last generated vend price information corresponding to the price data established by said price data entry means, (u) effect re-initialization of the vending system for subsequent operation.

40. The vend control circuit of claim 39 wherein said microprocessor is further programmed to proceed to step (u) if the program has not progressed from step (p) to step (t) within a pre-established reset time interval.

41. The vend control circuit of claim 39 wherein said microprocessor is programmed to initiate program step (p) in response to said price arming signal.

42. The vend control circuit of claim 39 including means to generate a trigger signal, wherein said microprocessor is operatively connected to receive and is responsive to said trigger signal, and wherein said microprocessor is further programmed to be responsive to said price arming signal to (1) check to determine whether said trigger signal has been received and, if so, proceed to step (p), or, if not, proceed to step (1).

43. The vend control circuit of claim 42 wherein said microprocessor is further programmed to proceed to step (u) if the program has not progressed from step (1) to step (p) within a pre-established reset time interval.

44. The vend control circuit of claim 43 including a vend selection monitor means connected to detect any actuation of the selection means by a customer and to be responsive thereto to produce a trigger signal.

45. The vend control circuit of claim 44 wherein said vend selection monitor means includes a first portion and a second portion under control of said first portion, said first portion connected in circuit with the selection means and having energized and de-energized states, operation of the selection means effecting a change in state of said first portion of said vend selection monitor means, said second portion responsive to such change in state of said first portion to produce said trigger signal.

46. In a vend control device having a credit unit where credit entries are made, means for accumulating the value of credit entered, a plurality of vend selection switches actuatable by a customer to select a particular vend section, and a plurality of vend delivery means, each vend selection having a vend delivery means associated therewith, the improvement comprising a plurality of vend channels each of which may have a different pre-established vend price associated therewith, master control means for sequentially comparing the amount of credit entered during a vend operation against the pre-established vend price for each of the respective vend channels and for producing on said channel whose vend price has undergone comparison a first condition when the amount of credit entered at least equals the vend price associated therewith and a second condition when the amount of credit entered is less than the vend price associated therewith, delivery control means independent of said master control means and responsive to particular coincident productions of said first conditions by said master control means and actuations of the vend selection switches to effect energization of respective vend delivery means, said responsive delivery control means effecting energization of a particular vend delivery means independently of any further comparisons by said master control means when a vend selection by the customer occurs at the same time as a first condition exists on the vend channel associated with the selected vend selection, and means responsive to energization of any vend delivery means to inhibit further sequential comparisons.

47. The improvement of claim 46 wherein said master control means includes clock means for periodically initiating sequential comparisons.

48. The improvement of claim 46 including means responsive to actuation of any of said plurality of selection switches to produce a trigger signal, said master control means including a trigger input connected to receive said trigger signal, said master control means responsive to said trigger signal to initiate sequential comparisons.

49. The improvement of claim 46 including means for establishing a vend price for each vend channel, such establishing means including means actuatable by service personnel to produce price signals and address signals, said master control means including data storage means having addresses associated with respective vend channels, said master control means responsive to actuation by service personnel of said actuatable means to store the price signal produced at the address corresponding to the address signal produced.

50. A vend control system including credit entry means for receiving acceptable credit entries and for producing credit entry signals, master control means connected to said credit entry means to receive said credit entry signals and to accumulate total credit entered, a plurality of vend channels, each of which may have a different pre-established vend price associated therewith, customer actuatable selection means for selecting a vend selection, delivery control means including a plurality of vend delivery means, each vend selection having a vend delivery means associated therewith and being associated with a vend channel, said master control means operable to sequentially compare total credit accumulated against, in turn, the vend price for each vend channel and, for each such comparison, to produce a vend channel authorization signal identifying the vend channel whose vend price has undergone comparison if the total credit accumulated at least equals the vend price, said delivery control means connected to said selection means and also connected to receive vend channel authorization signals produced by said master control means, energization of the vend delivery means associated with a particular vend selection being effected by the simultaneous production of a vend channel authorization signal identifying the particular vend channel with which said vend selection is associated and actuation of said selection means to select such particular vend selection, and vend energization monitor means connected to monitor energization of any vend delivery means and to produce a vend energized signal, said master control means responsive to said vend energized signal to terminate further sequential comparisons.

51. The vend control system of claim 50 including a power source and wherein said selection means includes a plurality of vend selection switches, each vend selection switch being connected in series with a vend delivery means, said delivery control means including a plurality of gating means with inputs operatively connected in common to said power source, each gating means associated with a respective vend channel and including a control input and an output, each vend selection switch operatively connected in series circuit to the output of one of said gating means, the control inputs of said gating means each connected to receive a respective vend channel authorization signal.

52. The vend control system of claim 50 wherein said selection means is connected to said vend delivery control means, actuation of said selection means producing selection identification signals, each selection identification signal being associated with a vend channel and having first and second parameters associated therewith defining a parameter pair, each vend delivery means having first and second input connections, means connecting the first input connections of said vend delivery means into a plurality of common connected sets of the first input connections corresponding respectively to different possible parameters of the first parameter associated with a selection identification signal, means connecting the second input connection of said vend delivery means into different common connected sets of said second input connections corresponding respectively to different possible parameters of the second parameter associated with the selection identification signal, a source of energy having first and second outputs for connecting across a selected one of the vend delivery means to energize same, said delivery control means connected to receive each vend channel authorization signal and selection identification signal and to be responsive thereto when the selection identification signal received is associated with the vend channel whose vend channel authorization signal is simultaneously being received for effecting operative connection between the first output of the energy source and a selected one of the output connections to the first set of vend delivery means that corresponds to the first parameter of the selection identification signal and between the second output of the energy source and a selected one of the input connections to the second set of vend delivery means that corresponds to the other parameter of the selection identification signal.

53. The vend delivery system of claim 52 wherein said selection means includes a plurality of vend selection switches.

54. The vend delivery system of claim 52 wherein said selection means includes a keyboard.

55. The vend control system of claim 52 wherein said delivery control means includes encoder/decoder means having first and second sets of output connections, said encoder/decoder means connected to receive each said selection identification signal and to produce on said first and second sets of output connections first and second sets of coded output signals identifying respective first and second parameters associated with said selection identification signal, each parameter pair of a selection identification signal being associated with a vend channel authorization signal, a comparator means connected to receive said first and second sets of coded output signals and said vend channel authorization signal and responsive thereto to generate an enable signal if the parameter pair of said coded output signals is associated with such vend channel authorization signal, and means responsive to said enable signal to effect operative connection between the first output of the energy source and a selected one of the output connections to the first set of vend delivery means that corresponds to the first parameter of the selection identification signal and between the second output of tne energy source and a selected one of the input connections to the second set of vend delivery means that corresponds to the other parameter of the selection identification signal.

56. The vend control system of claim 55 wherein said delivery control means includes first and second drive circuits and a gating means having an input, an output, and a control connection, said first output of said energy source operatively connected to said input of said gating means, said first drive circuit having a power input connection to tne output of said gating means, a plurality of inputs connected respectively to the first set of output connections of said encoder/decoder means, and a plurality of output connections connected respectively to the sets of first input connections to the vend delivery means, said second drive circuit having a power input connection to the second output of said energy source, a plurality of inputs connected respectively to the second set of output connections of said encoder/decoder means, and a plurality of output connections connected respectively to the sets of second input connections to the vend delivery means.

57. In a vend control device having a credit unit where credit entries are made, means for accumulating the value of credit entered, a plurality of vend selection switches actuatable by a customer to select a particular vend selection, and a plurality of vend delivery means, each vend selection having a vend delivery means associated therewith, the improvement comprising a plurality of vend channels each of which may have a different pre-established vend price associated therewith, master control means for sequentially comparing the amount of credit entered during a vend operation against the pre-established vend price for each of the respective vend channels and for producing on said channel whose vend price has undergone comparison a first condition when the amount of credit entered at least equals the vend price associated therewith and a second condition when the amount of credit entered is less than the vend price associated therewith, means to energize a particular vend delivery means when a vend selection switch with which such particular vend delivery means is associated is actuated while a first condition exists on the vend channel to which the actuated selection switch belongs, means responsive to energization of any vend delivery means to effect termination by said master control means of further sequential comparisons, and means responsive to actuation of any of said plurality of selection switches to produce a trigger signal, said master control means including a trigger input connected to receive said trigger signal, said master control means responsive to said trigger signal to initiate sequential comparisons.

58. In a vend control device having a credit unit where credit entries are made, means for accumulating the value of credit entered, a plurality of vend selection switches actuatable by a customer to select a particular vend selection, and a plurality of vend delivery means, each vend selection having a vend delivery means associated therewith, the improvement comprising a plurality of vend channels each of which may have a different pre-established vend price associated therewith, master control means for sequentially comparing the amount of credit entered during a vend operation against the pre-established vend price for each of the respective vend channels and for producing on said channel whose vend price has undergone comparison a first condition when the amount of credit entered at least equals the vend price associated therewith and a second condition when the amount of credit entered is less than the vend price associated therewith, means to energize a particular vend delivery means when a vend selection switch with which such particular vend delivery means is associated is actuated while a first condition exists on the vend channel to which the actuated selection switch belongs, means responsive to energization of any vend delivery means to effect termination by said master control means of further sequential comparisons, and means for establishing a vend price for each vend channel, such establishing means including means actuatable by service personnel to produce price signals and address signals, said master control means including data storage means having addresses associated with respective vend channels, said master control means responsive to actuation by service personnel of said actuatable means to store the price signal produced at the address corresponding to the address signal produced.

59. The improvement of claim 46 wherein said inhibiting means includes means to effect termination by said master control means of further sequential comparisons.

60. The improvement of claim 46 wherein the vend selection switches of the vend control device each have an actuated and de-actuated condition and are each associated with a respective vend selection, and wherein said delivery control means effects energization of a particular vend delivery means when both a vend selection switch with which such particular vend delivery means is associated in an actuated condition and a first condition exists on the vend channel to which the actuated selection switch belongs.

* * * * *

UNITED STATES PATENT OFFICE
CERTIFICATE OF CORRECTION

Patent No. 4,526,263 Dated July 2, 1985

Inventor(s) Joseph L. Levasseur

It is certified that error appears in the above-identified patent and that said Letters Patent are hereby corrected as shown below:

Title Page, Section 54, in the title, delete the phrase "LOCK-AHEAD" and substitute therefor the phrase -- LOOK-AHEAD --.

Column 1, line 2, in the title, delete the phrase "LOCK-AHEAD" and substitute therefor the phrase -- LOOK-AHEAD --.

Column 6, line 58, delete the word "wnich" and substitute therefor the word -- which --.

Column 7, line 60, delete the word "wnen" and substitute therefor the word -- when --.

Column 17, line 56, delete the word "nas" and substitute therefor the word -- has --.

Column 20, line 26, delete the word "tne" and substitute therefor the word -- the --.

Column 20, line 28, delete the word "Tne" and substitute therefor the word -- The --.

Column 20, line 35, delete the word "tne" and substitute therefor the word -- the --.

Column 28, line 18, before the phrase "write input pin P17" insert the symbol -- $\overline{W}$ --.

Column 33, line 38, delete the word "tne" and substitute therefor the word -- the --.

UNITED STATES PATENT AND TRADEMARK OFFICE

CERTIFICATE OF CORRECTION

PATENT NO. : 4,526,263

DATED : July 2, 1985

INVENTOR(S) : Joseph L. Levasseur

It is certified that error appears in the above-identified patent and that said Letters Patent is hereby corrected as shown below:

Column 38, line 26, delete the word "tne" and substitute therefor the word -- the --.

Column 39, line 68, in the phrase "step (l)", delete the number symbol "1" and substitute therefor the lower case letter -- l --.

Column 40, line 3, in the phrase "step (l)", delete the number symbol "1" and substitute therefor the lower case letter -- l --.

Column 42, line 40, delete the word "tne" and substitute therefor the word -- the --.

Column 42, line 51, delete the word "tne" and substitute therefor the word -- the --.

Column 44, line 34, before the phrase "in an" insert the word -- is --.

Signed and Sealed this

Eighth Day of October 1985

[SEAL]

Attest:

DONALD J. QUIGG

Attesting Officer

Commissioner of Patents and Trademarks—Designate